US011618657B2

(12) United States Patent
Wakabayashi et al.

(10) Patent No.: US 11,618,657 B2
(45) Date of Patent: Apr. 4, 2023

(54) LIFTING/LOWERING DEVICE

(71) Applicant: FUNAI ELECTRIC CO., LTD., Osaka (JP)

(72) Inventors: Naoyuki Wakabayashi, Osaka (JP); Fuminori Tanaka, Osaka (JP); Jun Sugimoto, Osaka (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 0 days.

(21) Appl. No.: 17/711,035

(22) Filed: Apr. 1, 2022

(65) Prior Publication Data

US 2022/0219956 A1 Jul. 14, 2022

Related U.S. Application Data

(63) Continuation of application No. 16/817,598, filed on Mar. 12, 2020, now Pat. No. 11,332,349.

(30) Foreign Application Priority Data

Apr. 10, 2019 (JP) ..... JP2019-075096

(51) Int. Cl.
*B66F 3/24* (2006.01)
*B66F 3/35* (2006.01)

(52) U.S. Cl.
CPC ..... *B66F 3/247* (2013.01); *B66F 3/35* (2013.01)

(58) Field of Classification Search
CPC .... B66F 3/247; B66F 3/00; B66F 3/24; B66F 3/35; B66F 3/40
See application file for complete search history.

(56) References Cited

U.S. PATENT DOCUMENTS

| | | | | |
|---|---|---|---|---|
| 11,332,349 | B2 * | 5/2022 | Wakabayashi | B66F 3/247 |
| 2020/0325008 | A1 * | 10/2020 | Wakabayashi | B66F 3/247 |
| 2022/0219956 | A1 * | 7/2022 | Wakabayashi | B66F 3/35 |

* cited by examiner

*Primary Examiner* — Lee D Wilson
(74) *Attorney, Agent, or Firm* — JCIPRNET

(57) ABSTRACT

The lifting/lowering device (100) includes: a first plate member (51); a second plate member (52) to which the first plate member (51) is rotatably connected; a first expansion and contraction bag (31) which is disposed between the first plate member (51) and the second plate member (52) and is capable of expanding and contracting by gas supply and exhaust; a third plate member (53) to which the second plate member (52) is rotatably connected; a second expansion and contraction bag which is disposed between the second plate member (52) and the third plate member (53) and is capable of expanding and contracting by gas supply and exhaust. The first plate member (51), the first expansion and contraction bag (31), the second plate member (52), the second expansion and contraction bag (32) and the third plate member (53) are disposed so as to overlap in a plan view.

8 Claims, 14 Drawing Sheets

LIFTING/LOWERING DEVICE

CROSS-REFERENCE TO RELATED APPLICATION

This application is a continuation application of and claims the priority benefit of a prior application Ser. No. 16/817,598, filed on Mar. 12, 2020, now allowed. The prior application claims the priority of Japan patent application serial no. 2019-075096, filed on Apr. 10, 2019. The entirety of the above-mentioned patent application is hereby incorporated by reference herein and made a part of this specification.

BACKGROUND OF THE DISCLOSURE

Technical Field

The disclosure relates to a lifting/lowering device.

Related Art

Conventionally, a lifting/lowering device used for lifting/lowering a person or an object is known (for example, see patent literature 1 (Japanese Patent Laid-open No. 3-281869)).

In the above-described patent literature 1, a lifting/lowering device is disclosed which includes a column disposed below a floor, a lifting/lowering mechanism which lifts/lowers the column, and an inclination driving device which inclines the floor by expansion and contraction of a rod disposed below the floor. In the lifting/lowering device of the above-described patent literature 1, the inclination driving device which inclines the floor by the expansion and contraction of the rod is arranged above the lifting/lowering mechanism which moves the floor up and down by lifting/lowering the column, and thereby the floor is moved up and down and inclined.

However, in the lifting/lowering device recited in patent literature 1, the floor is moved up and down and inclined by the lifting and lowering of the column and the expansion and contraction of the rod disposed below the floor, and thus an arrangement space for arranging the rod in a contracted state or the column below the floor is required. Therefore, there is a problem that the arrangement space in an up-down direction of the movable portion of the lifting/lowering device increases.

The disclosure provides a lifting/lowering device capable of suppressing an arrangement space in an up-down direction of a movable portion from increasing.

SUMMARY

A lifting/lowering device according to one aspect of the disclosure includes: a first plate member which is arranged on a side where an object to be lifted/lowered is disposed; a second plate member which is disposed below the first plate member and has a first side to which the first plate member is rotatably connected; a first expansion and contraction bag which is disposed between the first plate member and the second plate member and is capable of expanding and contracting by gas supply and exhaust; a third plate member which is disposed below the second plate member and to which the second plate member is rotatably connected at a second side different from the first side of the second plate member; and a second expansion and contraction bag which is disposed between the second plate member and the third plate member and is capable of expanding and contracting by gas supply and exhaust, wherein the first plate member, the first expansion and contraction bag, the second plate member, the second expansion and contraction bag and the third plate member are disposed so as to overlap in a plan view.

DESCRIPTION OF THE EMBODIMENTS

Figure 1:
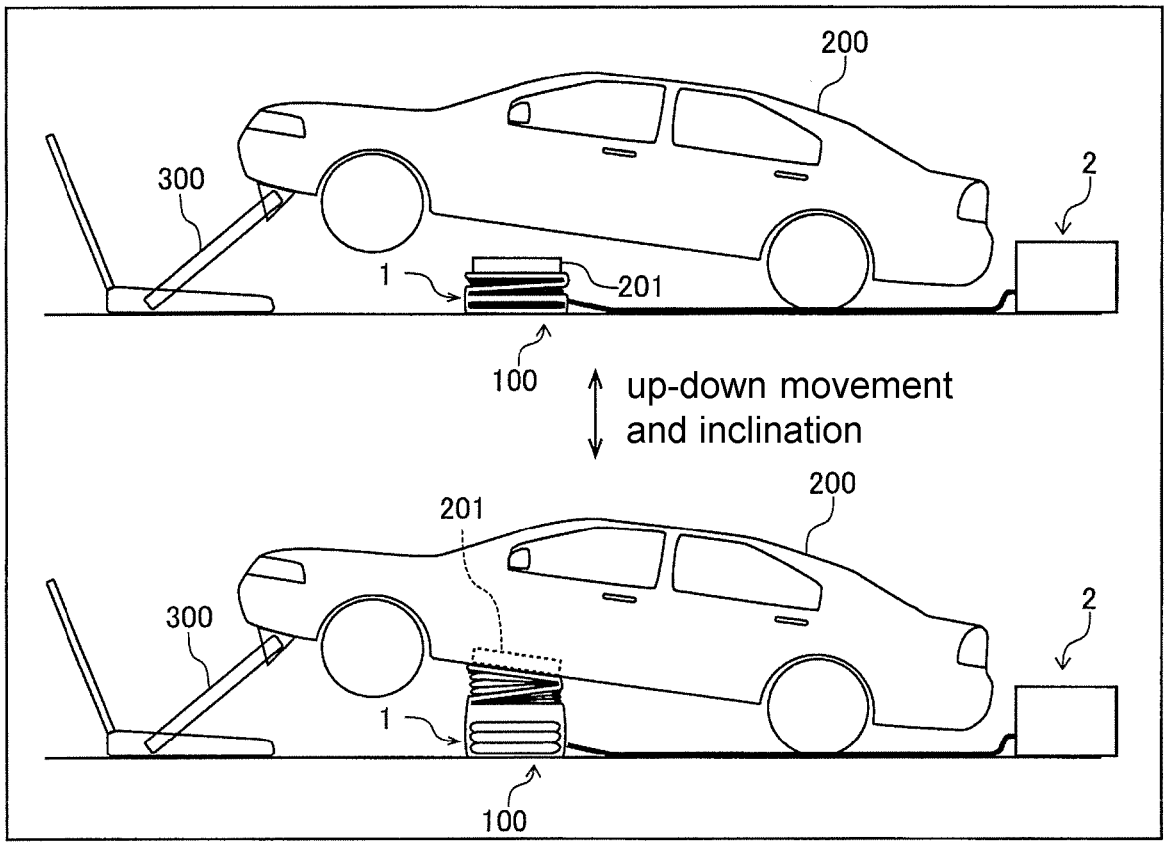
FIG. 1 is an overall view of a lifting/lowering device according to a first embodiment.

In the lifting/lowering device according to one aspect of the disclosure, the first plate member, the first expansion and contraction bag, the second plate member, the second expansion and contraction bag and the third plate member are disposed so as to overlap in a plan view, and lifting/lowering is performed by expanding and contracting the expansion and contraction bags disposed between the plate members by gas supply and exhaust, and thus by contracting the expansion and contraction bags, the expansion and contraction bags are flattened to be placed between the plate members. Thereby, the arrangement space of the movable portion can be reduced compared with a case of using a member for moving a rod, a column or the like having a certain size even in a contracted state, and thus the lifting/lowering device which can suppress the increase in the arrangement space in the up-down direction of the movable portion can be provided. In addition, the first plate member is rotatable so as to be inclined around a rotation axis along the first side of the second plate member, and the second plate member is rotatable so as to be inclined around a rotation axis along the second side which is connected to the third plate member, and thereby, when the first side and the second side of the second plate member faces each other in a plan view, the first plate member and the second plate member are rotated so as to be inclined in directions opposite to each other. Thereby, the first plate member can be moved horizontally up and down by equalizing the rotation angles of the first plate member and the second plate member, and the first plate member can be inclined by making the rotation angles of the first plate member and the second plate member different, and thus the first plate member can be moved up and down and inclined by a common mechanism. As a result, compared with the case in which the column for performing up-down movement is arranged, an increase in the size of the movable portion can be suppressed and the arrangement space in the up-down direction of the movable portion can be suppressed from increasing. Moreover, the plate members are members having an outer shape having a sufficiently large length on a plane as compared with a thickness. For example, the plate members may be not only a solid plate member but also a hollow member. Alternatively, the plate members may be a member in which a hole is formed, or a lattice-shaped member.

The lifting/lowering device according to the above-described aspect preferably further includes a control portion which controls, based on an inclination angle of the first plate member, the supply and exhaust of the gas to and from the first expansion and contraction bag and the second expansion and contraction bag to make the first plate member move up and down or incline. According to this configuration, the inclination angle of the first plate member with respect to the object to be lifted/lowered can be changed into a desired angle by controlling the gas supply and exhaust based on the inclination angle of the first plate member. As a result, the inclination angle of the object to be lifted/lowered arranged above the first plate member can be changed into a desired angle during the lifting/lowering.

In this case, preferably, the control portion calculates a height position of the first plate member based on inclination angles of the first plate member and the second plate member, and controls, based on the inclination angle of the first plate member and the calculated height position of the first plate member, the supply and exhaust of the gas to and from the first expansion and contraction bag and the second expansion and contraction bag to make the first plate member move up and down or incline. According to this configuration, by controlling the supply and exhaust of the gas to and from the first expansion and contraction bag and the second expansion and contraction bag based on the calculated height position of the first plate member, the height position of the first plate member can be changed to a desired height position.

The lifting/lowering device according to the above-described aspect preferably further includes: a first detection portion which detects the inclination angle of the first plate member; and a second detection portion which detects the inclination angle of the second plate member, wherein the control portion calculates the height position of the first plate member based on the inclination angle of the first plate member and the inclination angle of the second plate member which are detected by the first detection portion and the second detection portion, and controls, based on the inclination angle of the first plate member and the calculated height position of the first plate member, the supply and exhaust of the gas to and from the first expansion and contraction bag and the second expansion and contraction bag to make the first plate member move up and down or incline. According to this configuration, by the first detection portion and the second detection portion, in addition to the detection of the inclination angle of the first plate member and the inclination angle of the second plate member, the height position can be calculated. As a result, compared with a case where a measuring device such as a laser distance measuring device or the like is separately arranged to measure the height position, the height position can be easily measured.

The lifting/lowering device according to the above-described aspect preferably further includes: a pump for supplying and exhausting the gas to and from the first expansion and contraction bag and the second expansion and contraction bag; and a channel switching portion which switches channels for supplying and exhausting the gas to and from the first expansion and contraction bag and the second expansion and contraction bag, wherein the control portion controls, based on the inclination angle of the first plate member, the pump and the channel switching portion to supply and exhaust the gas to and from the first expansion and contraction bag and the second expansion and contraction bag and switch the channels so that the first plate member is moved up and down or inclined. According to this configuration, by switching the gas channels using the channel switching portion, it is not necessary to arrange the pump for expanding and contracting the expansion and contraction bags on each of the expansion and contraction bags. That is, the plurality of expansion and contraction bags (the first expansion and contraction bag and the second expansion and contraction bag) can be expanded and contracted by a single pump. As a result, compared with a case where the pump for expanding and contracting the expansion and contraction bags is arranged on each of the expansion and contraction bags, complication and enlargement of the device due to an increase in the number of components can be suppressed.

The lifting/lowering device according to the above-described aspect preferably further includes: a first pressure sensor which measures pressure inside the first expansion and contraction bag; and a second pressure sensor which measures pressure inside the second expansion and contraction bag, wherein the control portion performs control of stopping supplying gas to the first expansion and contraction bag when the pressure inside the first expansion and contraction bag which is measured by the first pressure sensor exceeds a first predetermined upper limit value, and stopping supplying gas to the second expansion and contraction bag when the pressure inside the second expansion and contraction bag which is measured by the second pressure sensor exceeds a second predetermined upper limit value. According to this configuration, by measuring the pressures of the first expansion and contraction bag and the second expansion and contraction bag to control the supply of gas to the first expansion and contraction bag and the second expansion and contraction bag, the respective pressures inside the first expansion and contraction bag and the second expansion and contraction bag can be controlled. As a result, the supply of gas to the first expansion and contraction bag and the second expansion and contraction bag can be easily controlled.

In the lifting/lowering device according to the above-described aspect, preferably, the second plate member has a substantially trapezoidal shape having a long side and a short side parallel to each other in a plan view, and the first plate member or the second plate member is rotated around a rotation axis along a side intersecting the long side and the short side parallel to each other in the substantially trapezoidal shape of the second plate member. According to this configuration, unlike in a case that square and rectangular plate members are combined and inclined in order to incline the plate members in directions intersecting obliquely with respect to a long side and a short side parallel to each other in a plan view, the plate members can be inclined in the directions intersecting obliquely with respect to a long side and a short side parallel to each other in a plan view by the rotation around only one rotation axis. As a result, the plate members can be inclined in obliquely intersecting directions with a simple configuration.

The lifting/lowering device according to the above-described aspect preferably further includes: a fourth plate member which is disposed below the third plate member and has a fifth side to which the third plate member is rotatably connected at a fourth side different from a third side of the third plate member connected to the second plate member; a third expansion and contraction bag which is disposed between the third plate member and the fourth plate member and is capable of expanding and contracting by gas supply and exhaust; a fifth plate member which is disposed below the fourth plate member and to which the fourth plate member is rotatably connected at a sixth side different from the fifth side of the fourth plate member, and a fourth expansion and contraction bag which is disposed between the fourth plate member and the fifth plate member and is capable of expanding and contracting by gas supply and exhaust, wherein the first plate member, the first expansion and contraction bag, the second plate member, the second expansion and contraction bag, the third plate member, the third expansion and contraction bag, the fourth plate member, the fourth expansion and contraction bag and the fifth plate member are disposed so as to overlap in a plan view, and at least two of the rotation axes when the first plate member, the second plate member, the third plate member, the fourth plate member and the fifth plate member are rotated intersect in a plan view. According to this configuration, the directions in which the plate members are rotated to be inclined can be increased corresponding to the number of the plate members. As a result, for example, the directions in which the plate members are rotated to be inclined can be increased in a front-rear direction and a left-right direction, and thus more complicated actions of up-down movement and inclination can be performed.

The lifting/lowering device according to the one aspect of the disclosure preferably further includes an image capturing portion which captures an image of the object to be lifted/lowered which is arranged above the first plate member, wherein the control portion controls, based on the image captured by the image capturing portion, the supply and exhaust of the gas to and from the first expansion and contraction bag and the second expansion and contraction bag. According to this configuration, using the captured image, an inclination angle of the object to be lifted/lowered can be calculated and the supply and exhaust of the gas to and from the first expansion and contraction bag and the second expansion and contraction bag can be controlled, and thus during the lifting/lowering, the up-down movement or the inclination of the lifting/lowering device can be controlled while the inclination angle of the object to be lifted/lowered is checked.

According to the disclosure, the lifting/lowering device which can suppress the arrangement space in the up-down direction of the movable portion from increasing can be provided.

Embodiments for embodying the disclosure are described below with reference to the drawings.

First Embodiment

A configuration according to a first embodiment of the disclosure is described with reference to FIG. 1-FIG. 11.

As shown in FIG. 1, a lifting/lowering device 100 in the first embodiment includes a movable portion 1 and a drive device 2. In the lifting/lowering device 100, the movable portion 1 in which a battery 201 is arranged on an upper surface is disposed below a vehicle body of an electric automobile 200 which is raised by a jack 300, the movable portion 1 is moved up and down and inclined by the drive device 2, and thereby the battery 201 mounted to the electric automobile 200 can be replaced.

Figure 2:
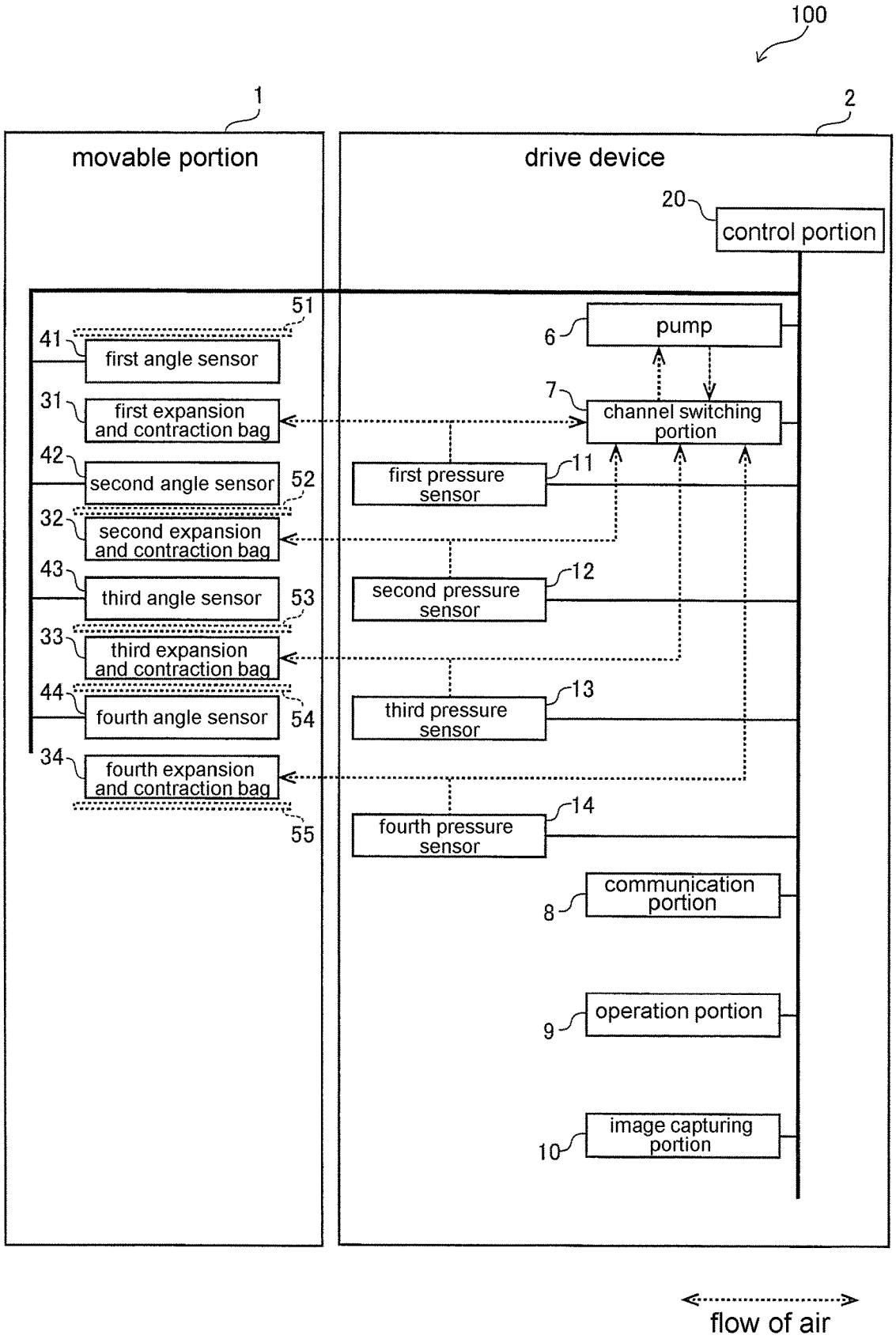
FIG. 2 is a block diagram of the lifting/lowering device according to the first embodiment.

As shown in FIG. 2, the movable portion 1 includes a first expansion and contraction bag 31, a second expansion and contraction bag 32, a third expansion and contraction bag 33, and a fourth expansion and contraction bag 34. In addition, in the movable portion 1, a first angle sensor 41, a second angle sensor 42, a third angle sensor 43, and a fourth angle sensor 44 are arranged. Moreover, the first angle sensor 41 is an example of a "first detection portion" in the claims, and the second angle sensor 42 is an example of a "second detection portion" in the claims. In addition, in the movable portion 1, a first plate member 51, a second plate member 52, a third plate member 53, a fourth plate member 54, and a fifth plate member 55 are arranged.

In addition, in the drive device 2, a pump 6, a channel switching portion 7, a communication portion 8, an operation portion 9, an image capturing portion 10, and a control portion 20 are arranged. In addition, in the drive device 2, pressure sensors (a first pressure sensor 11, a second pressure sensor 12, a third pressure sensor 13 and a fourth pressure sensor 14) are arranged on channels of gas (air) from the channel switching portion 7 to each expansion and contraction bag (the first expansion and contraction bag 31, the second expansion and contraction bag 32, the third expansion and contraction bag 33 and the fourth expansion and contraction bag 34).

The expansion and contraction bags (the first expansion and contraction bag 31, the second expansion and contraction bag 32, the third expansion and contraction bag 33 and the fourth expansion and contraction bag 34) are expanded and contracted by the supply and exhaust of the gas (air). In addition, the channels for supplying and exhausting air by the pump 6 arranged in the drive device 2 are arranged for the expansion and contraction bags. Moreover, in the first embodiment, an example is shown in which air (around the drive device 2) is used as an example of "gas" to be supplied and exhausted, but the gas to be supplied and exhausted may also be oxygen, carbon dioxide, nitrogen and water vapor, or a rare gas such as helium, neon, argon or the like. In addition, the gas which is supplied and exhausted may be a mixed gas of the above-described gases.

The angle sensors (the first angle sensor 41, the second angle sensor 42, the third angle sensor 43 and the fourth angle sensor 44) are sensors for detecting inclination angels. In addition, the angle sensors are connected to the control portion 20 of the drive device 2 and are configured to transmit the detected inclination angles to the control portion 20. Moreover, the angle sensors include an acceleration sensor which detects inclination of the sensors with reference to accelerations.

The plate members (the first plate member 51, the second plate member 52, the third plate member 53, the fourth plate member 54 and the fifth plate member 55) are configured to clamp each expansion and contraction bag in the up-down direction. The plate member includes a member being plate-like and including a honeycomb structure and a pair of aluminum materials which clamping the honeycomb structure. Moreover, the plate member may be a member having an outer shape having a sufficiently large length on a plane as compared with a thickness. For example, the plate member may be not only a solid plate member but also a hollow member. Alternatively, the plate member may be a member in which a hole is formed, or a lattice-shaped member.

The pump 6 is connected to each expansion and contraction bag arranged in the movable portion 1, and is configured to supply and exhaust the gas (air) to and from each expansion and contraction bag.

The channel switching portion 7 is configured to switch the channels for supplying and exhausting the gas (air) to and from each expansion and contraction bag. The channel switching portion 7 includes an electromagnetic valve and is connected to the control portion 20.

The communication portion 8 is configured to receive an action instruction for controlling the lifting/lowering device 100 transmitted from an external host device through at least one of wireless communication and wired communication. The communication portion 8 is connected to the control portion 20, and the received action instruction is transmitted to the control portion 20.

The operation portion 9 is arranged for an operator to operate the lifting/lowering device 100, and is configured to accept an input operation of the operator. The accepted operation is transmitted to the control portion 20.

The image capturing portion 10 captures an image of an object to be lifted/lowered which is disposed above the first plate member 51. Specifically, the image capturing portion 10 is configured to capture an image of the battery 201 serving as the object to be lifted/lowered by the lifting/lowering device 100. The image capturing portion 10 includes an image sensor and is connected to the control portion 20.

The pressure sensors (the first pressure sensor 11, the second pressure sensor 12, the third pressure sensor 13, and the fourth pressure sensor 14) are sensors for measuring pressures inside respective expansion and contraction bag. The pressure sensors are connected to the control portion 20 and configured to transmit measurement results of the pressures to the control portion 20.

Based on the instruction received by the communication portion 8 and the operation accepted by the operation portion 9, the control portion 20 controls the pump 6 and the channel switching portion 7 to make each expansion and contraction bag expand and contract, and makes the first plate member 51, the second plate member 52, the third plate member 53, and the fourth plate member 54 are rotated around rotation axes so as to be inclined.

In addition, in the first embodiment, the control portion 20 controls the supply and exhaust of the gas (air) to and from the first expansion and contraction bag 31 and the second expansion and contraction bag 32 to make the first plate member 51 move up and down or incline based on an inclination angle of the first plate member 51 as described later.

In addition, in the first embodiment, the control portion 20 controls the supply and exhaust of the gas (air) to and from the first expansion and contraction bag 31 and the second expansion and contraction bag 32 based on the image captured by the image capturing portion 10. Specifically, the control portion 20 performs an image process on the image captured by the image capturing portion 10 and calculates an inclination angle of the battery 201 itself mounted on the lifting/lowering device 100. Based on the calculated inclination angle, the control portion 20 controls the supply and exhaust of air to and from the first expansion and contraction bag 31, the second expansion and contraction bag 32, the third expansion and contraction bag 33, and the fourth expansion and contraction bag 34 and adjusts the inclination angles of the first plate member 51 and the battery 201 which is the object to be lifted/lowered. In addition, the control portion 20 acquires an amount of change in the inclination angle of the battery 201 which is the object to be lifted/lowered from the image captured by the image capturing portion 10, and stops the pump 6 from supplying air when the amount of change in the inclination angle is greater than a given level.

(Configurations of Plate Members and Expansion and Contraction Bags)

The first embodiment includes: the first plate member 51 which is arranged on a side on which the object to be lifted/lowered is arranged; the second plate member 52 which is disposed below the first plate member 51 and has a first side 521 to which the first plate member 51 is rotatably connected; the first expansion and contraction bag 31 which is arranged between the first plate member 51 and the second plate member 52 and can be expanded and contracted by the supply and exhaust of the gas (air); the third plate member 53 which is disposed below the second plate member 52 and to which the second plate member 52 is rotatably connected at a second side 522 which is different from the first side 521 of the second plate member 52; and the second expansion and contraction bag 32 which is arranged between the second plate member 52 and the third plate member 53 and can be expanded and contracted by the supply and exhaust of the gas (air). In addition, the first plate member 51, the first expansion and contraction bag 31, the second plate member 52, the second expansion and contraction bag 32 and the third plate member 53 are arranged so as to overlap in a plan view.

Figure 3:
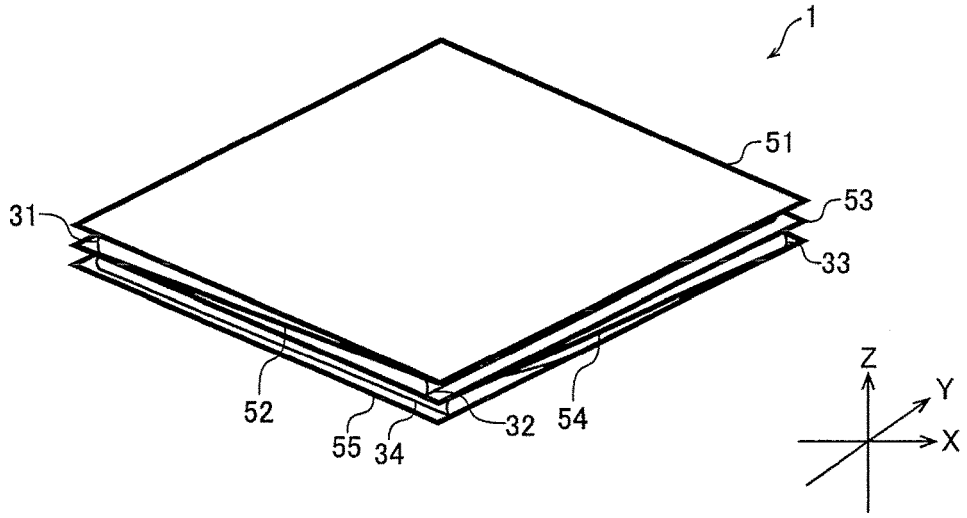
FIG. 3 is a schematic diagram of a movable portion in a state that all the expansion and contraction bags of the lifting/lowering device according to the first embodiment are contracted.
Figure 4:
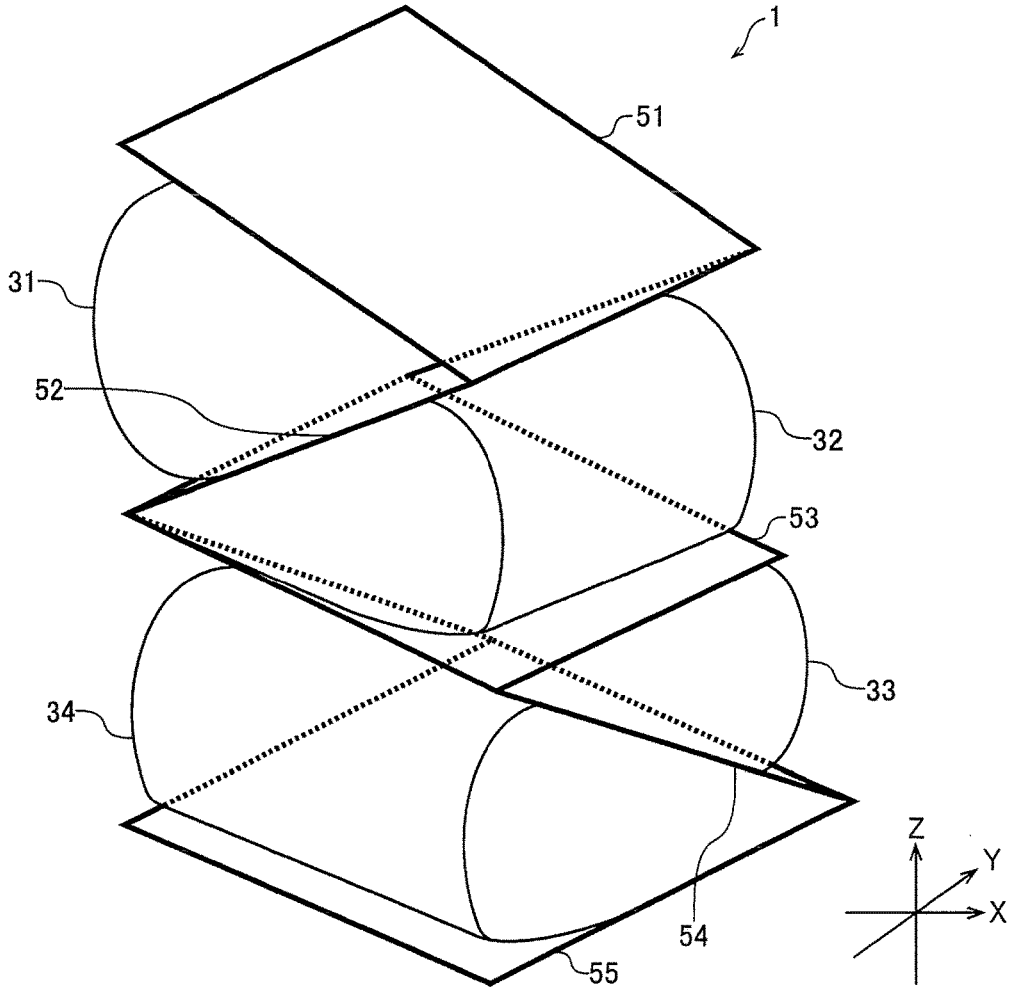
FIG. 4 is a schematic diagram of the movable portion in a state that all the expansion and contraction bags of the lifting/lowering device according to the first embodiment are expanded.

Specifically, as shown in FIG. 3 and FIG. 4, the plate members (the first plate member 51, the second plate member 52, the third plate member 53, the fourth plate member 54 and the fifth plate member 55) are arranged in a manner of clamping the expansion and contraction bags (the first expansion and contraction bag 31, the second expansion and contraction bag 32, the third expansion and contraction bag 33, and the fourth expansion and contraction bag 34) from the up-down direction. In addition, the first plate member 51 is rotatable around a rotation axis along the first side 521 of the second plate member 52 so as to be inclined, and the second plate member 52 is rotatable around a rotation axis along the second side 522 connected to the third plate member 53 so as to be inclined. Moreover, the plate members have a rectangular shape in a plan view. Moreover, FIG. 3 is a schematic diagram of a state in which all of the expansion and contraction bags are contracted, and FIG. 4 is a schematic diagram of a state in which all of the expansion and contraction bags are expanded. Accordingly, the plate members and the expansion and contraction bags are arranged so as to overlap in a plan view, and by expanding the expansion and contraction bags, the plurality of plate members is pushed up by the expansion and contraction bags and is rotated around the respective rotation axes so as to be inclined.

Figure 5:
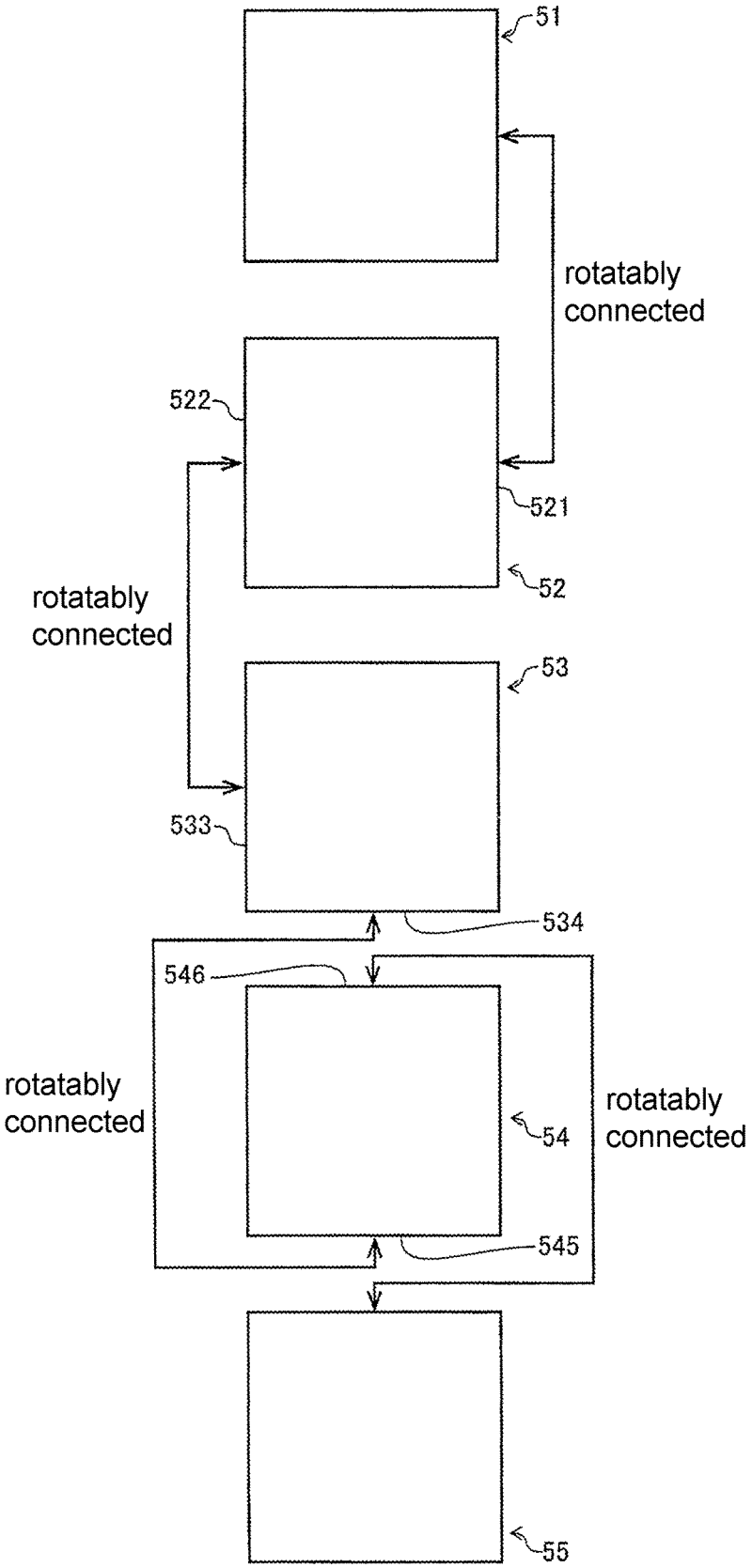
FIG. 5 is a schematic diagram for illustrating connection of plate members of the lifting/lowering device according to the first embodiment.

As shown in FIG. 4 and FIG. 5, the plurality of plate members (the first plate member 51, the second plate member 52, the third plate member 53, the fourth plate member 54 and the fifth plate member 55) is respectively rotatably connected to other plate members which are arranged adjacent from above, from below, or from both the upper side and the lower side.

The first plate member 51 is a plate member which is disposed at the uppermost position and is disposed on the side where the battery 201 which is the object to be lifted/lowered is disposed. The first plate member 51 is rotatably connected to the first side 521 of the second plate member 52 disposed below, and is rotated so as to be inclined around the rotation axis along the first side 521 of the second plate member 52 by the expansion and contraction of the first expansion and contraction bag 31 disposed below.

The second plate member 52 is connected to the first plate member 51 disposed above on the first side 521. In addition, the second plate member 52 is rotatably connected to the third plate member 53 disposed below at the second side 522 facing the first side 521, and is rotated so as to be inclined around the rotation axis along the second side 522 by the expansion and contraction of the second expansion and contraction bag 32 disposed below.

The third plate member 53 is connected to the second plate member 52 disposed above at a third side 533. In addition, the third plate member 53 is rotatably connected to the fourth plate member 54 disposed below at a fourth side 534 which intersects the third side 533 at a right angle, and is rotated so as to be inclined around a rotation axis along the fourth side 534 by the expansion and contraction of the third expansion and contraction bag 33 disposed below.

In addition, the first embodiment further includes: the fourth plate member 54 which is disposed below the third plate member 53 and has a fifth side 545 to which the third plate member 53 is rotatably connected at the fourth side 534 different from the third side 533 of the third plate member 53 connected to the second plate member 52; the third expansion and contraction bag 33 which is disposed between the third plate member 53 and the fourth plate member 54 and can be expanded and contracted by the supply and exhaust of the gas (air); the fifth plate member 55 which is disposed below the fourth plate member 54 and to which the fourth plate member 54 is rotatably connected at a sixth side 546 different from the fifth side 545 of the fourth plate member 54; and the fourth expansion and contraction bag 34 which is disposed between the fourth plate member 54 and the fifth plate member 55 and can be expanded and contracted by the supply and exhaust of the gas (air). In addition, the first plate member 51, the first expansion and contraction bag 31, the second plate member 52, the second expansion and contraction bag 32, the third plate member 53, the third expansion and contraction bag 33, the fourth plate member 54, the fourth expansion and contraction bag 34 and the fifth plate member 55 are disposed so as to overlap in a plan view, and at least two of the rotation axes when the first plate member 51, the second plate member 52, the third plate member 53, the fourth plate member 54 and the fifth plate member 55 are rotated intersect in a plan view.

Specifically, the fourth plate member 54 is connected to the third plate member 53 disposed above at the fifth side 545. In addition, the fourth plate member 54 is rotatably connected to the fifth plate member 55 disposed below on the sixth side 546 facing the fifth side 545, and is rotated so as to be inclined around a rotation axis along the sixth side 546 by the expansion and contraction of the fourth expansion and contraction bag 34 disposed below.

The fifth plate member 55 is connected to the sixth side 546 of the fourth plate member 54 disposed above and is a plate member serving as a support member when the fourth plate member 54 is rotated.

The first side 521, the second side 522, and the third side 533 are substantially parallel to each other in a plan view. In addition, the fourth side 534, the fifth side 545, and the sixth side 546 are substantially parallel to each other in a plan view. In addition, the first side 521, the second side 522, and the third side 533 intersect the fourth side 534, the fifth side 545, and the sixth side 546 in a plan view.

The rotation axes when the first plate member 51 and the second plate member 52 are rotated so as to be inclined are substantially parallel in a plan view. In addition, the rotation axes when the third plate member 53 and the fourth plate member 54 are rotated so as to be inclined are substantially parallel in a plan view. In addition, the rotation axes when the first plate member 51 and the second plate member 52 are rotated so as to be inclined and the rotation axes when the third plate member 53 and the fourth plate member 54 are rotated so as to be inclined are configured to be substantially orthogonal (intersect) in a plan view.

(Configuration of Movable Portion)

Figure 6:
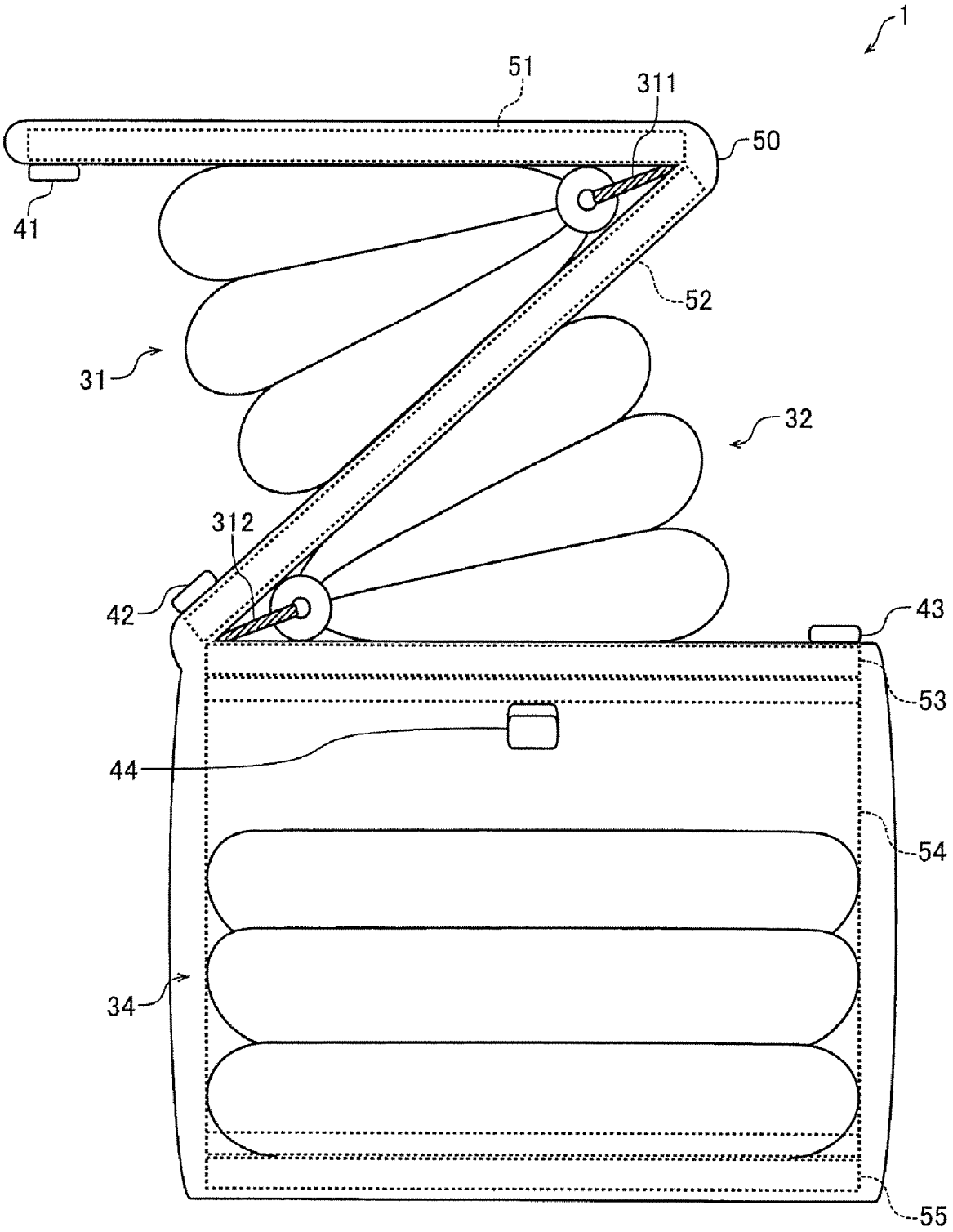
FIG. 6 is a first side view of the movable portion viewed from a fourth side of a third plate member of the lifting/lowering device according to the first embodiment.
Figure 7:
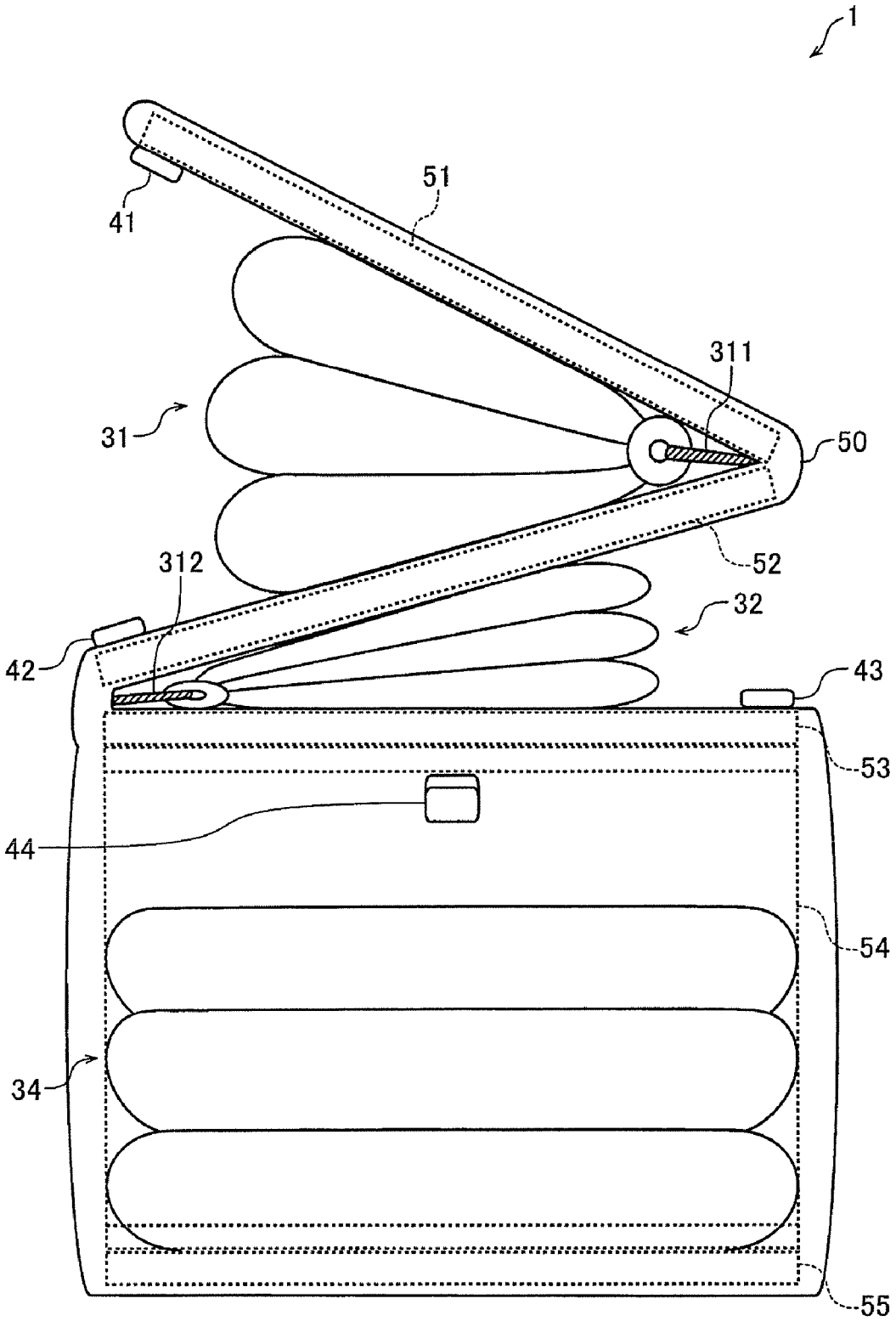
FIG. 7 is a second side view of the movable portion viewed from the fourth side of the third plate member of the lifting/lowering device according to the first embodiment.

Next, a configuration of the movable portion 1 of the first embodiment is described with reference to FIG. 6-FIG. 8. FIG. 6 is a first side view of the movable portion 1 as viewed from the fourth side 534 of the third plate member 53. In FIG. 6, the lifting/lowering device 100 makes each expansion and contraction bag (the first expansion and contraction bag 31, the second expansion and contraction bag 32, the third expansion and contraction bag 33 and the fourth expansion and contraction bag 34) expand, and makes the first plate member 51, the second plate member 52, the third plate member 53, and the fourth plate member 54 rotate so as to incline outward around the respective rotation axes. FIG. 7 is a side view of the movable portion 1 in a state that the second expansion and contraction bag 32 is contracted from the state in FIG. 6 and the second plate member 52 is rotated so as to be inclined inward around the rotation axis as viewed from the fourth side 534 of the third plate member 53. By rotating the second plate member 52, the first plate member 51 is inclined toward the rotation axis. In addition, FIG. 8 is a side view of the movable portion 1 in the state shown in FIG. 6 as viewed from the first side 521 of the second plate member 52.

Figure 8:
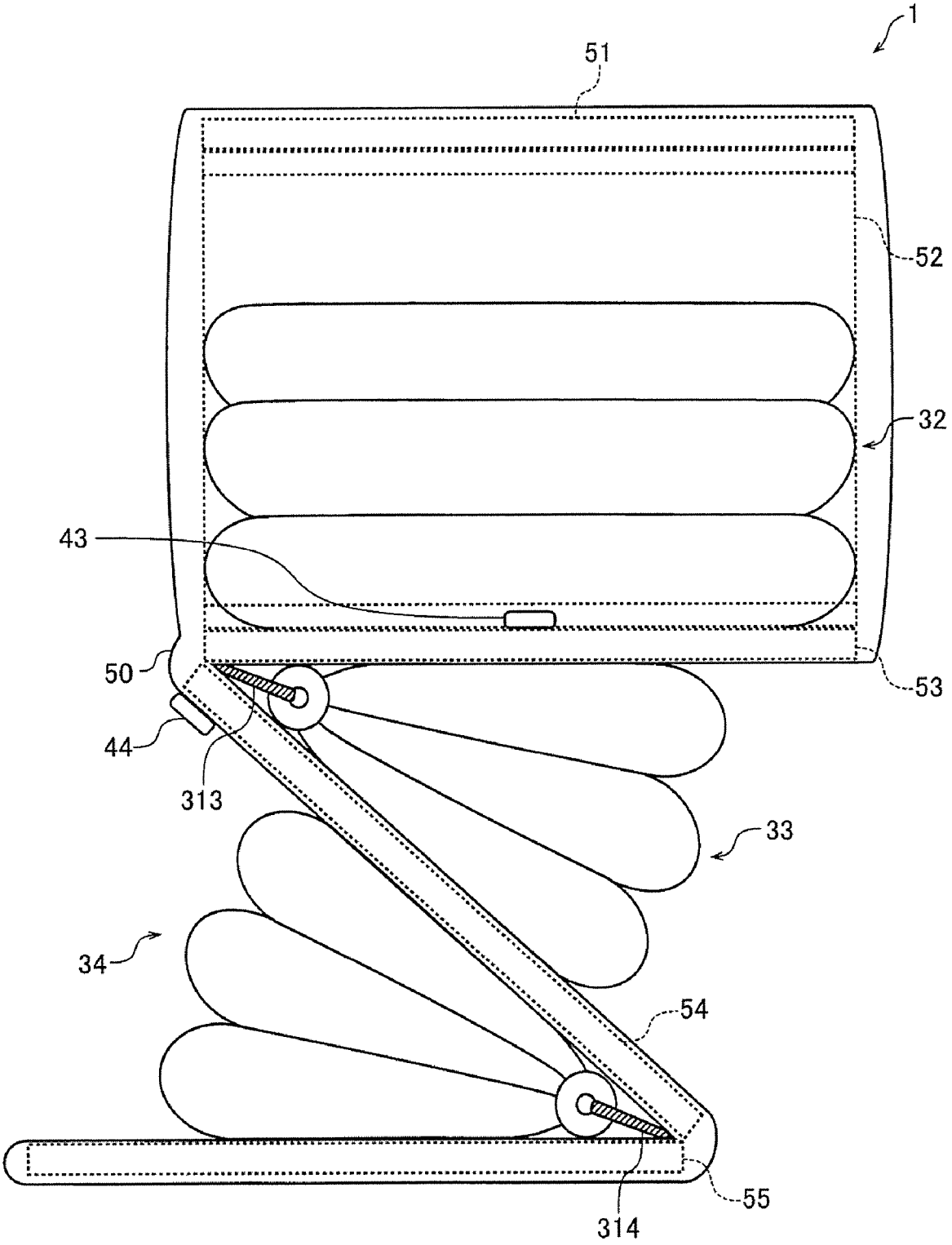
FIG. 8 is a side view of the movable portion viewed from a first side of a second plate member of the lifting/lowering device according to the first embodiment.

The plate members (the first plate member 51, the second plate member 52, the third plate member 53, the fourth plate member 54, and the fifth plate member 55) are configured to be wrapped by sheets 50 (see FIG. 6-FIG. 8). The plate members (the first plate member 51, the second plate member 52, the third plate member 53, the fourth plate member 54, and the fifth plate member 55) are rotatably connected, by the sheets 50 wrapping the plate members, to the plate members arranged adjacent from above, from below, or from both the upper side and the lower side. Moreover, the plate member may be directly connected by hinges, clothes or the like which are fixed to the plate members.

In addition, in the first embodiment, the lifting/lowering device 100 further includes a first detection portion which detects the inclination angle of the first plate member 51 and a second detection portion which detects the inclination angle of the second plate member 52. Specifically, in the first plate member 51, the second plate member 52, the third plate member 53, and the fourth plate member 54, the angle sensors (the first angle sensor 41, the second angle sensor 42, the third angle sensor 43 and the fourth angle sensor 44) are arranged as sensors for detecting the inclination angles. The first angle sensor 41 is a sensor for detecting the inclination angle of the first plate member 51 and is installed on a lower surface of the first plate member 51. The second angle sensor 42 is a sensor for detecting the inclination angle of the second plate member 52 and is installed on an upper surface of the second plate member 52. In addition, the third angle sensor 43 is a sensor for detecting the inclination angle of the third plate member 53 and is installed on an upper surface of the third plate member 53. In addition, the fourth angle sensor 44 is a sensor for detecting the inclination angle of the fourth plate member 54 and is installed on a lower surface of the fourth plate member 54.

In addition, the expansion and contraction bags are configured by stacking a plurality of bags which is formed by welding or bonding edges of two sheet-like members and which is substantially flat when contracted. In addition, one ends of the plurality of stacked bags configuring the expansion and contraction bags are welded or bonded together. In addition, the expansion and contraction bags (the first expansion and contraction bag 31, the second expansion and contraction bag 32, the third expansion and contraction bag 33 and the fourth expansion and contraction bag 34) have annular parts arranged at the one ends which are welded or bonded, and are fixed to the sheets 50 or the plate members (the first plate member 51, the second plate member 52, the third plate member 53, the fourth plate member 54 and the fifth plate member 55) by each fixing portion (a first fixing portion 311, a second fixing portion 321, a third fixing portion 331 and a fourth fixing portion 341) in a manner of being pulled to sides of the rotation axes of the plate members disposed above. The fixing portions are, for example, string-like members and may fix the expansion and contraction bags to the sheets 50 or the plate members by passing the fixing portions through holes in the annular parts of the expansion and contraction bags.

(Height Position Calculation Method)

In the first embodiment, the control portion 20 calculates a height position of the first plate member 51 based on the inclination angles of the first plate member 51 and the second plate member 52, and controls, based on the inclination angle of the first plate member 51 and the calculated height position of the first plate member 51, the supply and exhaust of the gas (air) to and from the first expansion and contraction bag 31 and the second expansion and contraction bag 32 to make the first plate member 51 move up and down or incline.

Specifically, the control portion 20 calculates a center height of the first plate member 51 in a plan view using lengths L of the plate members in directions orthogonal to the rotation axes in a plan view and angles formed by a horizontal plane and lines of the first plate member 51, the second plate member 52, the third plate member 53, and the fourth plate member 54 orthogonal to the rotation axes. A method for calculating the center height of the first plate member 51 in a plan view is described with reference to FIG. 9. Moreover, in FIG. 9, the first plate member 51 to the third plate member 53 are shown for simplification. In addition, in FIG. 9, the third plate member 53 is in a horizontal state.

Figure 9:
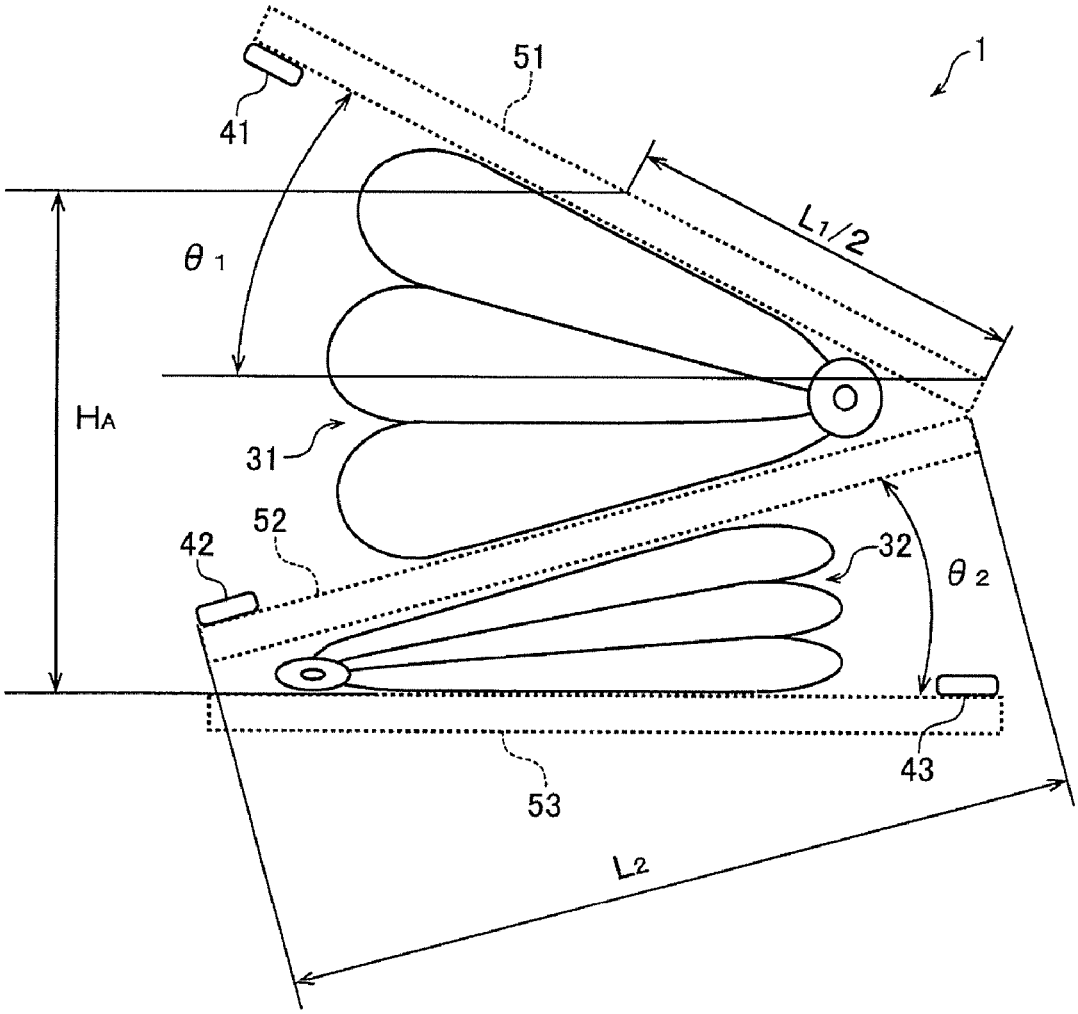
FIG. 9 is a schematic diagram for illustrating a method for calculating a height position of a first plate member of the lifting/lowering device according to the first embodiment.

As shown in FIG. 9, $L_1$ is a length of the first plate member 51 in a direction orthogonal to the rotation axis in a plan view of the first plate member 51, and $L_2$ is a length of the second plate member 52 in a direction orthogonal to the rotation axis in a plan view of the second plate member 52. In addition, $\theta_1$ is an angle formed by a line of the first plate member 51 orthogonal to the rotation axis and the horizontal plane, and $\theta_2$ is an angle formed by a line of the second plate member 52 orthogonal to the rotation axis and the horizontal plane. From the angles formed by the lines of the plate members orthogonal to the rotation axes and the horizontal plane, a center height $H_A$ of the first plate member 51 in a plan view from the upper surface of the third plate member 53 is obtained by Equation (1).

$$H_A=L_2\cdot\sin\theta_2+L_1/2\cdot\sin\theta_1 \quad (1)$$

Furthermore, when the third expansion and contraction bag 33, the fourth plate member 54, the fourth expansion and contraction bag 34 and the fifth plate member 55 are added, a center height $H_B$ of the first plate member 51 in a plan view from an upper surface of the fifth plate member 55 can be obtained by Equation (2).

$$H_B=L_4\cdot\sin\theta_4+L_3/2\cdot\sin\theta_3+L_2\cdot\sin\theta_2+L_1/2\cdot\sin\theta_1 \quad (2)$$

$L_3$ is a length of the third plate member 53 in a direction orthogonal to the rotational axis in a plan view of the third plate member 53, and $L_4$ is a length of the fourth plate member 54 in a direction orthogonal to the rotational axis in a plan view of the fourth plate member 54. In addition, $\theta_3$ is an angle formed by a line of the third plate member 53 orthogonal to the rotation axis and the horizontal plane, and $\theta_4$ is an angle formed by a line of the fourth plate member 54 orthogonal to the rotation axis and the horizontal plane. When the center height $H_B$ of the first plate member 51 in a plan view and inclination of the uppermost surface are indicated by the communication portion 8 or the operation portion 9, the control portion 20 obtains target values of $\theta_1$, $\theta_2$, $\theta_3$, and $\theta_4$ by the above-described Equation (2), and controls the supply and exhaust of the air to and from the expansion and contraction bags to expand and contract the expansion and contraction bags so that the angles detected by the angle sensors are the target values, thereby rotating the first plate member 51, the second plate member 52, the third plate member 53 and the fourth plate member 54.

In addition, in the first embodiment, the control portion 20 calculates the height position of the plate member 51 based on the inclination angle of the first plate member 51 and the inclination angle of the second plate member 52 detected by the first detection portion and the second detection portion, and controls, based on the inclination angle of the first plate member 51 and the calculated height position of the first plate member 51, the supply and exhaust of the gas (air) to and from the first expansion and contraction bag 31 and the second expansion and contraction bag 32 to make the first plate member 51 move up and down or incline. Specifically, the control portion 20 uses the first angle sensor 41 arranged in the first plate member 51 and the second angle sensor 42 arranged in the second plate member 52 to detect the angles ($\theta_1$ and $\theta_2$) formed by the lines of respective plate members orthogonal to the rotation axes and the horizontal plane. In addition, the control portion 20 uses the third angle sensor 43 arranged in the third plate member 53 and the fourth angle sensor 44 arranged in the fourth plate member 54 to detect the angles ($\theta_3$ and $\theta_4$) formed by the lines of respective plate members orthogonal to the rotation axes and the horizontal plane. The control portion 20 calculates the center height $H_B$ of the first plate member 51 in a plan view from the detected angles ($\theta_1$, $\theta_2$, $\theta_3$, and $\theta_4$) formed by the lines of the first plate member 51, the second plate member 52, the third plate member 53 and the fourth plate member 54 orthogonal to the rotation axes and the horizontal plane, and controls the supply and exhaust of the gas to and from the expansion and contraction bags to expand and contract the expansion and contraction bags, thereby making the first plate member 51 (the second plate member 52, the third plate member 53 and the fourth plate member 54) move up and down or incline.

(Channel Switching Portion)

Figure 10:
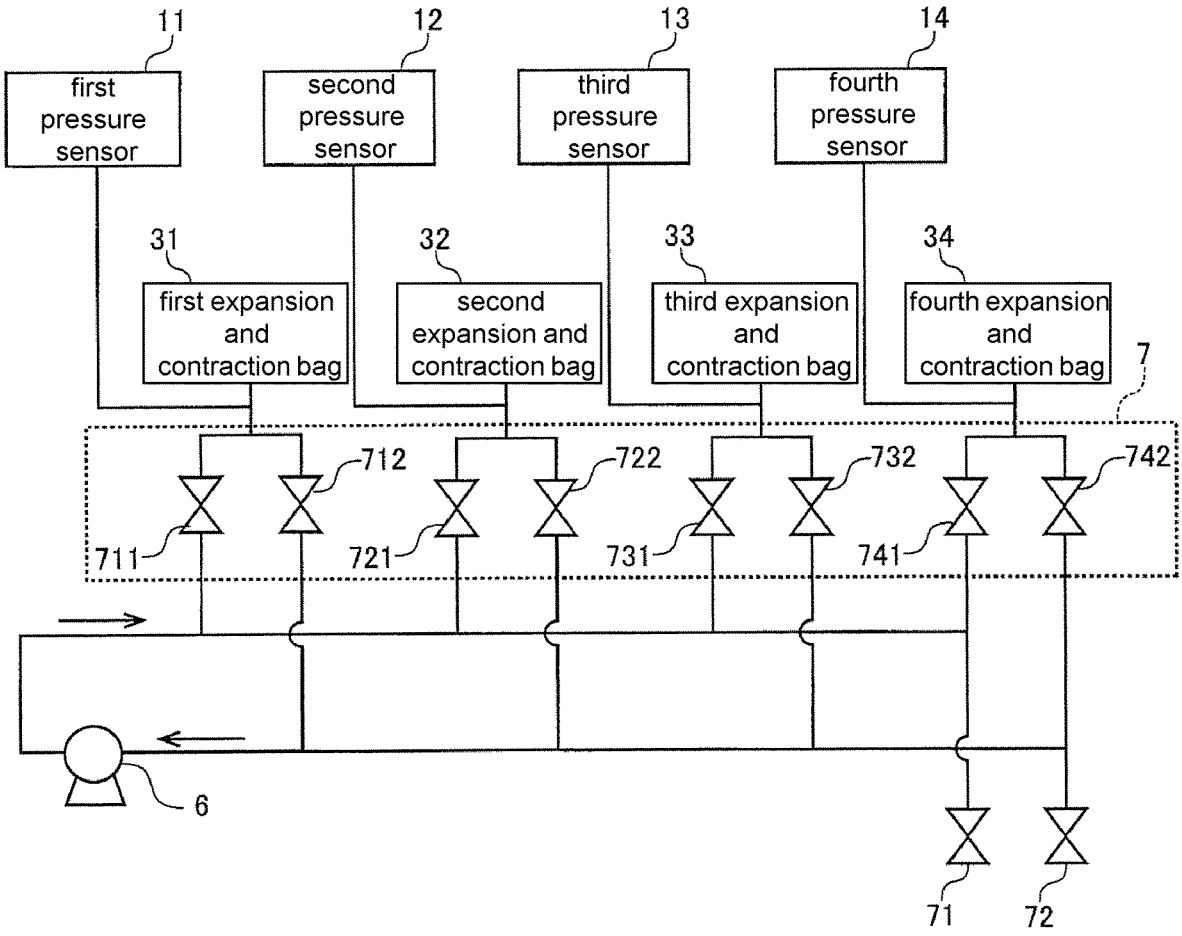
FIG. 10 is a block diagram of a channel switching portion of the lifting/lowering device according to the first embodiment.

In the first embodiment, the lifting/lowering device 100 further includes the pump 6 which supplies and exhausts the gas (air) to and from the first expansion and contraction bag 31 and the second expansion and contraction bag 32, and the channel switching portion 7 which switches the channels for supplying and exhausting the gas (air) to and from the first expansion and contraction bag 31 and the second expansion and contraction bag 32. Specifically, as shown in FIG. 10, the pump 6 for supplying and exhausting the air to and from each expansion and contraction bag (the first expansion and contraction bag 31, the second expansion and contraction bag 32, the third expansion and contraction bag 33, and the fourth expansion and contraction bag 34) is arranged on the air channels. In addition, the channel switching portion 7, a channel air supply electromagnetic valve 71 and a channel air exhaust electromagnetic valve 72 are arranged on the channels for supplying and exhausting the air to and from each expansion and contraction bag. Moreover, the channel air supply electromagnetic valve 71 is an electromagnetic valve which is opened when air is supplied to the channel, and the channel exhaust electromagnetic valve 72 is an electromagnetic valve which is opened when air is exhausted from the channel. In addition, the channel switching portion 7 is configured by a plurality of electromagnetic valves (a first air supply electromagnetic valve 711, a first air exhaust electromagnetic valve 712, a second air supply electromagnetic valve 721, a second air exhaust electromagnetic valve 722, a third air supply electromagnetic valve 731, a third air exhaust electromagnetic valve 732, a fourth air supply electromagnetic valve 741 and a fourth air exhaust electromagnetic valve 742) arranged on the channels for supplying and exhausting the air to and from each expansion and contraction bag. One air exhaust electromagnetic valve and one air supply electromagnetic valve are respectively arranged in each expansion and contraction bag. The first air supply electromagnetic valve 711 is an electromagnetic valve which is opened when air is supplied to the first expansion and contraction bag 31, and the first air exhaust electromagnetic valve 712 is an electromagnetic valve which is opened when air is exhausted from the first expansion and contraction bag 31. In addition, the second air supply electromagnetic valve 721 is an electromagnetic valve which is opened when air is supplied to the second expansion and contraction bag 32, and the second air exhaust electromagnetic valve 722 is an electromagnetic valve which is opened when air is exhausted from the second expansion and contraction bag 32. In addition, the third air supply electromagnetic valve 731 is an electromagnetic valve which is opened when air is supplied to the third expansion and contraction bag 33, and the third air exhaust electromagnetic valve 732 is an electromagnetic valve which is opened when air is exhausted from the third expansion and contraction bag 33. In addition, fourth air supply electromagnetic valve 741 is an electromagnetic valve which is opened when air is supplied to the fourth expansion and contraction bag 34, and the fourth air exhaust electromagnetic valve 742 is an electromagnetic valve which is opened when air is exhausted from the fourth expansion and contraction bag 34.

In addition, in the first embodiment, the control portion 20 controls, based on the inclination angle of the first plate member 51, the pump 6 and the channel switching portion 7 to supply and exhaust the gas (air) to and from the first expansion and contraction bag 31 and the second expansion and contraction bag 32 and switch the channels so that the first plate member 51 is moved up and down or inclined. The control portion 20 controls the pump 6 and controls open and close of each electromagnetic valve arranged on the channels to thereby individually control the supply and exhaust of the air to and from each expansion and contraction bag (the first expansion and contraction bag 31, the second expansion and contraction bag 32, the third expansion and contraction bag 33 and the fourth expansion and contraction bag 34). In addition, as described above, the control portion 20 performs these controls to make the first plate member 51 move up and down or incline based on the inclination angles detected by each angle sensor.

In addition, in the first embodiment, the lifting/lowering device 100 further includes the first pressure sensor 11 which measures the pressure inside the first expansion and contraction bag 31, and the second pressure sensor 12 which measures the pressure inside the second expansion and contraction bag 32. Specifically, pressure sensors (the first pressure sensor 11, the second pressure sensor 12, the third pressure sensor 13 and the fourth pressure sensor 14) which individually measure the pressure inside each expansion and contraction bag are arranged between each expansion and contraction bag and each electromagnetic valve. The first pressure sensor 11 is a sensor for measuring the pressure inside the first expansion and contraction bag 31. In addition, the second pressure sensor 12 is a sensor for measuring the pressure inside the second expansion and contraction bag 32. In addition, the third pressure sensor 13 is a sensor for measuring the pressure inside the third expansion and contraction bag 33. In addition, the fourth pressure sensor 14 is a sensor for measuring the pressure inside the fourth expansion and contraction bag 34.

In addition, in the first embodiment, the control portion 20 performs controls of stopping supplying the gas (air) to the first expansion and contraction bag 31 when the pressure inside the first expansion and contraction bag 31 which is measured by the first pressure sensor 11 exceeds a first predetermined upper limit value, and stopping supplying the gas (air) to the second expansion and contraction bag 32 when the pressure inside the second expansion and contraction bag 32 which is measured by the second pressure sensor 12 exceeds a second predetermined upper limit value.

(Abnormality Detection Process)

Figure 11:
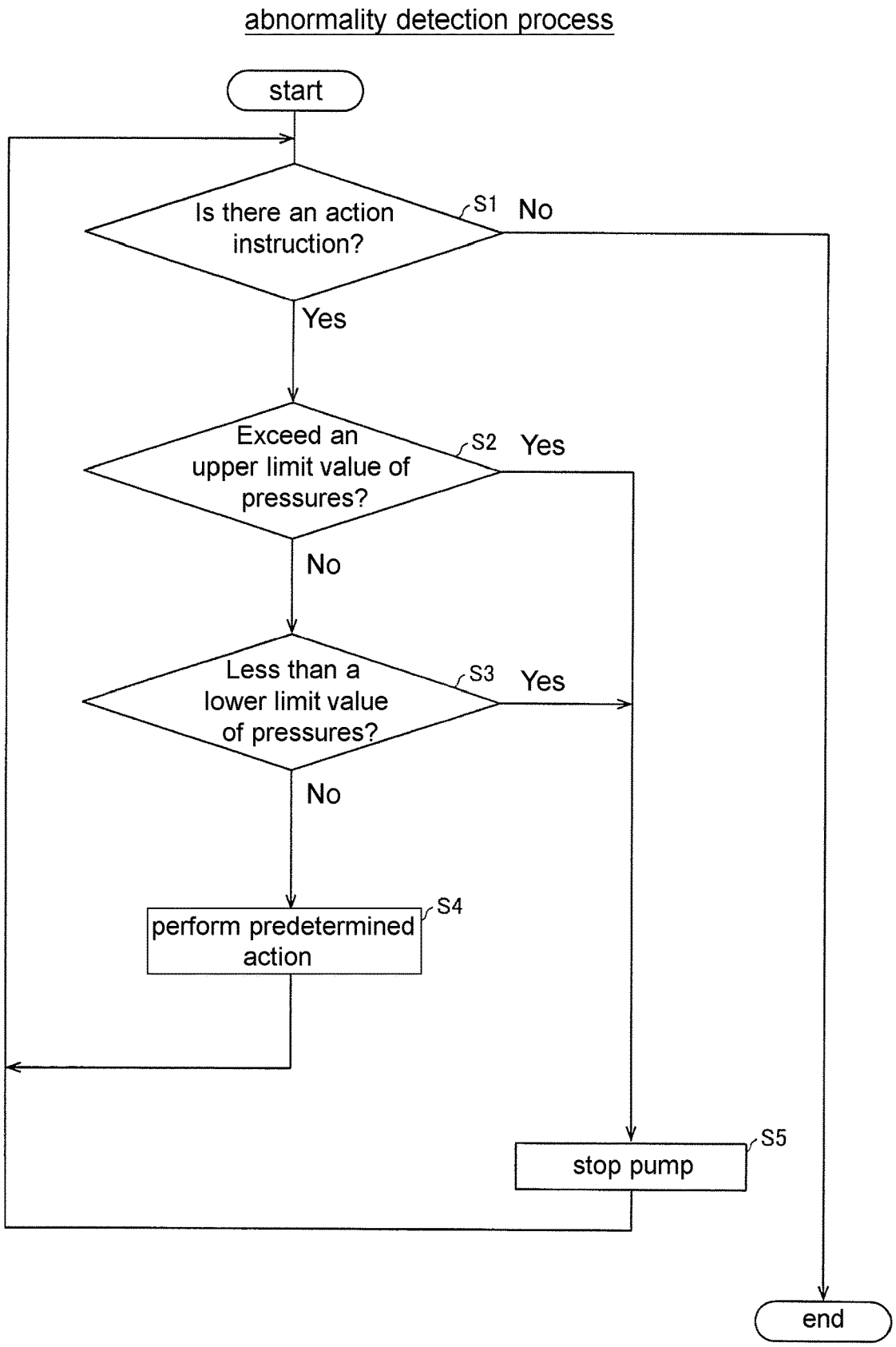
FIG. 11 is a flowchart of abnormality detection process control by a control portion of the lifting/lowering device according to the first embodiment.

Next, an example of an abnormality detection process performed by the control portion 20 of the lifting/lowering device 100 according to the first embodiment is described based on a flowchart with reference to FIG. 11.

In step S1, the control portion 20 determines whether there is an action instruction. When an action instruction is transmitted from the communication portion 8 or the operation portion 9 to the control portion 20, the process proceeds to step S2. In addition, if there is no action instruction, the process ends.

In step S2, the control portion 20 determines whether the pressure inside each expansion and contraction bag exceeds the upper limit value. The control portion 20 determines whether the pressures inside the expansion and contraction bags exceed the upper limit value based on measurement results of each pressure sensor (the first pressure sensor 11, the second pressure sensor 12, the third pressure sensor 13 and the fourth pressure sensor 14) which is individually arranged in the channel of each expansion and contraction bag (the first expansion and contraction bag 31, the second expansion and contraction bag 32, the third expansion and contraction bag 33 and the fourth expansion and contraction bag 34). When the pressure inside any one of the first expansion and contraction bag 31, the second expansion and contraction bag 32, the third expansion and contraction bag 33 and the fourth expansion and contraction bag 34 exceeds the upper limit value, the process proceeds to step S5. In addition, when none of the pressures inside the expansion and contraction bags exceeds the upper limit value, the process proceeds to step S3.

In step S3, the control portion 20 determines whether the pressure inside each expansion and contraction bag is less than a lower limit value. The control portion 20 determines whether the pressure inside each expansion and contraction bag is less than the lower limit value based on the measurement result of each pressure sensor arranged individually on the channel of each expansion and contraction bag. If the pressure in any one of the expansion and contraction bags is less than the lower limit value, the process proceeds to step S5. In addition, when none of the pressures in the expansion and contraction bags is less than the lower limit value, the process proceeds to step S4.

In step S4, the control portion 20 performs a predetermined action. The predetermined action is an action based on the action instruction transmitted from the communication portion 8 to the control portion 20 or an operation of the operation portion 9. The control portion 20 controls the pump 6 and the channel switching portion 7 so as to obtain a desired height position and a desired inclination angle based on the given action instruction or the operation of the operation portion 9, and supplies and exhausts air to and from each expansion and contraction bag. After the predetermined action is completed, the process returns to step S1.

In step S5, the control portion 20 stops the pump 6. After the pump 6 is stopped, the process returns to step S1.

(Effects of the First Embodiment)

In the first embodiment, the following effects can be obtained.

In the first embodiment, as described above, the expansion and contraction bags disposed between the plate members are expanded and contracted by the air supply and exhaust to perform the lifting/lowering, and thus, the expansion and contraction bags can be flattened to be placed between the plate members by contracting the expansion and contraction bags. Thereby, an arrangement space of the movable portion 1 can be reduced as compared with a case of using a member for moving a rod, a column or the like having a certain size even in a contracted state, and thus the lifting/lowering device 100 which can suppress an increase in the arrangement space in the up-down direction of the movable portion 1 can be provided. In addition, since the first side 521 and the second side 522 of the second plate member 52 face each other in a plan view, the first plate member 51 and the second plate member 52 are rotated to be inclined in opposite directions. Accordingly, the first plate member 51 can be moved horizontally up and down by equalizing the rotation angles of the first plate member 51 and the second plate member 52, and the first plate member 51 can be inclined by making the rotation angles of the first plate member 51 and the second plate member 52 different, and thus the first plate member 51 can be moved up and down and inclined by a common mechanism. As a result, compared with a case of arranging a column for performing up-down movement, an increase in the size of the movable portion 1 can be suppressed and the arrangement space in the up-down direction of the movable portion 1 can be suppressed from increasing.

In the first embodiment, as described above, the control portion 20 is arranged which controls, based on the inclination angle of the first plate member 51, the supply and exhaust of the air to and from the first expansion and contraction bag 31 and the second expansion and contraction bag 32 to make the first plate member 51 move up and down or incline. Accordingly, by controlling the supply and exhaust of the air based on the inclination angle of the first plate member 51, the inclination angle of the first plate member 51 with respect to the battery 201 can be changed to a desired angle. As a result, the inclination angle of the battery 201 disposed above the first plate member 51 can be changed to a desired angle during the lifting/lowering.

In the first embodiment, as described above, the control portion 20 calculates the height position of the first plate member 51 based on the inclination angles of the first plate member 51 and the second plate member 52, and controls, based on the inclination angle of the first plate member 51 and the calculated height position of the first plate member 51, the supply and exhaust of the air to and from the first expansion and contraction bag 31 and the second expansion and contraction bag 32 to make the first plate member 51 move up and down or incline. Accordingly, by controlling the supply and exhaust of the air to and from the first expansion and contraction bag 31 and the second expansion and contraction bag 32 based on the calculated height position of the first plate member 51, the height position of the first plate member 51 can be changed to a desired height position such as a mounting position of the battery 201 of the electric automobile 200 or the like.

In the first embodiment, as described above, the control portion 20 calculates the height position of the first plate member 51 based on the inclination angle of the first plate member 51 and the inclination angle of the second plate member 52 which are detected by the first angle sensor 41 and the second angle sensor 42, and controls, based on the inclination angle of the first plate member 51 and the calculated height position of the first plate member 51, the supply and exhaust of the air to and from the first expansion and contraction bag 31 and the second expansion and contraction bag 32 to make the first plate member 51 move up and down or incline. Accordingly, by the first angle sensor 41 and the second angle sensor 42, in addition to the detection of the inclination angle of the first plate member 51 and the inclination angle of the second plate member 52, the height position can be calculated. As a result, compared with a case where a measuring device such as a laser distance measuring device or the like is separately arranged to measure the height position, the height position can be easily measured.

In the first embodiment, as described above, the control portion 20 controls, based on the inclination angle of the first plate member 51, the pump 6 and the channel switching portion 7 to supply and exhaust the air to and from the first expansion and contraction bag 31 and the second expansion and contraction bag 32 and switch the channels so that the first plate member 51 is moved up and down or inclined. Accordingly, by switching the air channels using the channel switching portion 7, it is not necessary to arrange the pump 6 for expanding and contracting the expansion and contraction bag on each of the expansion and contraction bags. That is, the plurality of expansion and contraction bags (the first expansion and contraction bag 31, the second expansion and contraction bag 32, the third expansion and contraction bag 33 and the fourth expansion and contraction bag 34) can be expanded and contracted by a single pump 6. As a result, compared with a case where the pump 6 for expanding and contracting the expansion and contraction bag is arranged in each of the expansion and contraction bags, complication and enlargement of the device due to an increase in the number of components can be suppressed.

In the first embodiment, as described above, the control portion 20 performs control of stopping supplying air to the first expansion and contraction bag 31 when the pressure inside the first expansion and contraction bag 31 which is measured by the first pressure sensor 11 exceeds the first predetermined upper limit value, and stopping supplying the air to the second expansion and contraction bag 32 when the pressure inside the second expansion and contraction bag 32 which is measured by the second pressure sensor 12 exceeds the second predetermined upper limit value. Accordingly, the respective pressures inside the first expansion and contraction bag 31 and the second expansion and contraction bag 32 can be controlled by measuring the pressure of the first expansion and contraction bag 31 and the pressure of the second expansion and contraction bag 32 and controlling the supply of the air to the first expansion and contraction bag 31 and the second expansion and contraction bag 32. As a result, the supply of the air to the first expansion and contraction bag 31 and the second expansion and contraction bag 32 can be easily controlled.

In the first embodiment, as described above, the first plate member 51, the first expansion and contraction bag 31, the second plate member 52, the second expansion and contraction bag 32, the third plate member 53, the third expansion and contraction bag 33, the fourth plate member 54, the fourth expansion and contraction bag 34 and the fifth plate member 55 are disposed so as to overlap in a plan view, and among the rotation axes of the rotation of the first plate member 51, the second plate member 52, the third plate member 53, the fourth plate member 54 and the fifth plate member 55, the rotation axes of the first plate member 51 and the second plate member 52 and the rotation axes of the third plate member 53 and the fourth plate member 54 intersect in a plan view. Accordingly, the directions in which the plate members are rotated to be inclined can be increased corresponding to the number of the plate members. As a result, the directions in which the plate members are rotated to be inclined can be increased in a front-rear direction and a left-right direction, and thus more complicated actions of up-down movement and inclination can be performed.

In the first embodiment, as described above, the control portion 20 controls, based on the image captured by the image capturing portion 10, the supply and exhaust of the air to and from the first expansion and contraction bag 31 and the second expansion and contraction bag 32. Accordingly, using the captured image, the inclination angle of the battery 201 can be calculated and the supply and exhaust of the air to and from the first expansion and contraction bag 31 and the second expansion and contraction bag 32 can be controlled, and thus during the lifting/lowering, the up-down movement or the inclination of the lifting/lowering device 100 can be controlled while the inclination angle of the battery 201 is checked.

Second Embodiment

Figure 12:
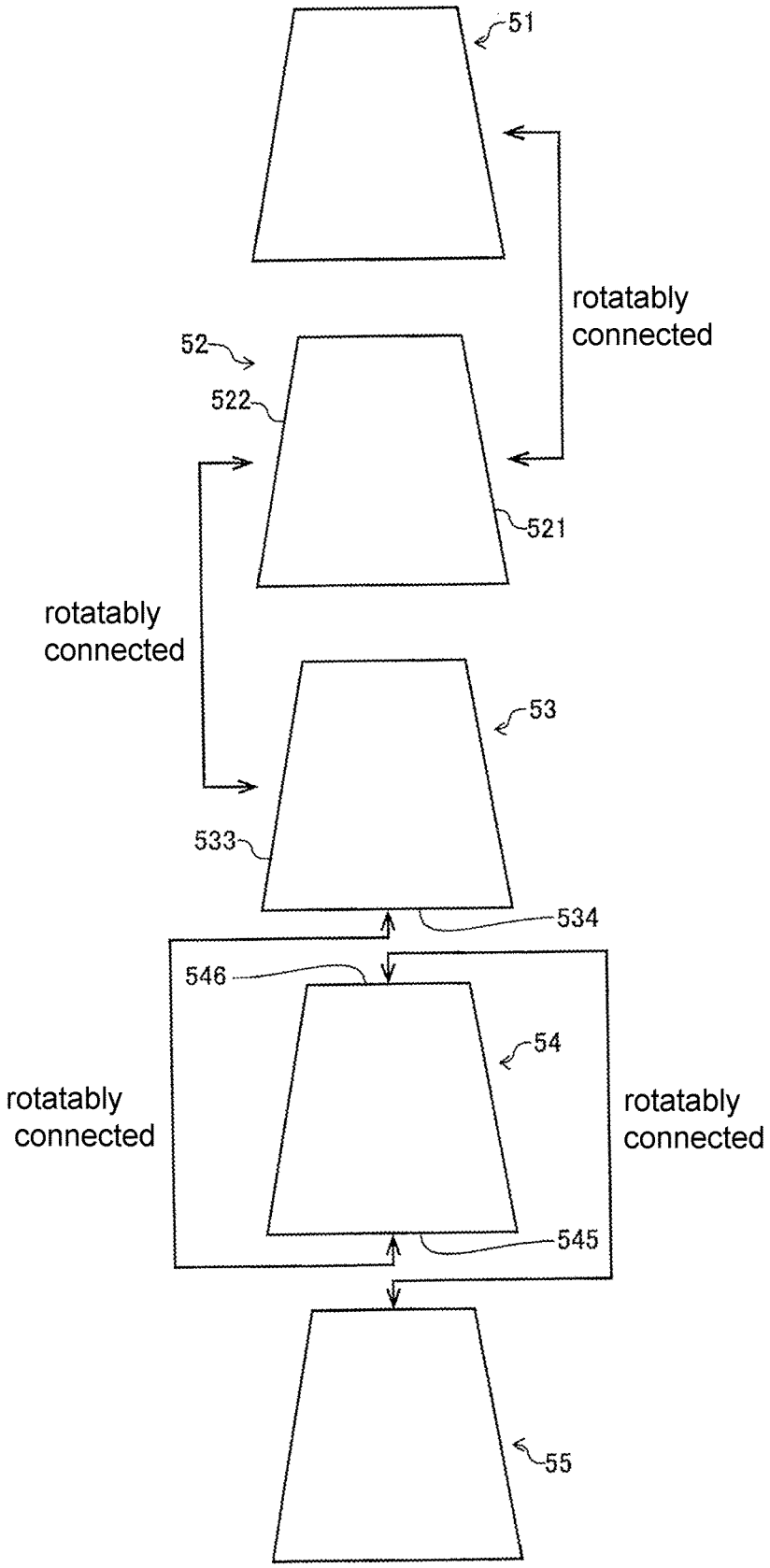
FIG. 12 is a schematic diagram for illustrating connection of plate members of a lifting/lowering device according to a second embodiment.
Figure 13:
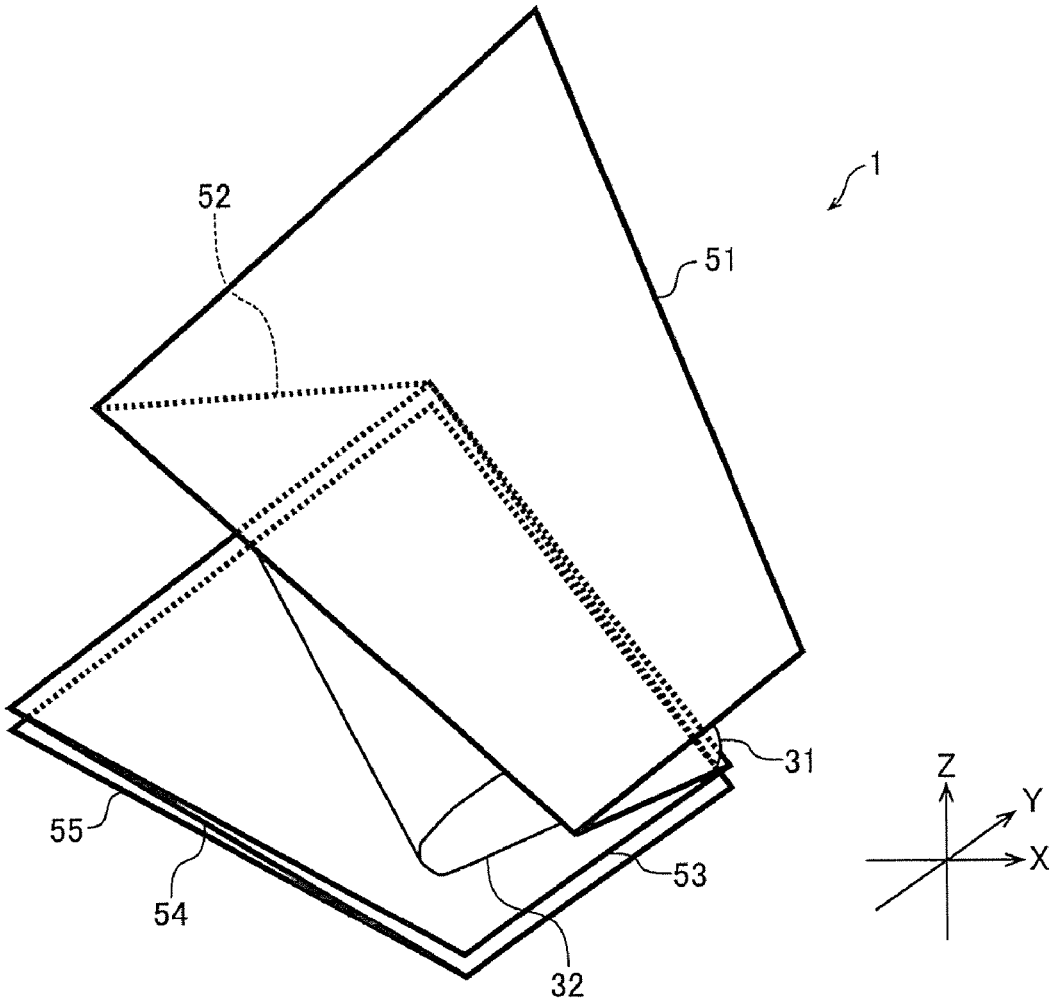
FIG. 13 is a schematic diagram of a movable portion in a state that a first expansion and contraction bag and a second expansion and contraction bag of the lifting/lowering device according to the second embodiment is expanded.

Next, a second embodiment is described with reference to FIG. 12 and FIG. 13. In the second embodiment, unlike the first embodiment which has a rectangular shape, the second plate member 52 has a trapezoidal shape having a long side and a short side parallel to each other in a plan view. In addition, the lifting/lowering device 100 (see FIG. 2) of the second embodiment is a seat surface of an automobile which is moved up and down and inclined when a passenger gets on and off the automobile.

In the second embodiment, the second plate member 52 has a substantially trapezoidal shape having a long side and a short side parallel to each other in a plan view, and the first plate member 51 or the second plate member 52 is rotated around a rotation axis along a side intersecting the long side and the short side parallel to each other of the substantially trapezoidal shape of the second plate member 52. Specifically, as shown in FIG. 12 and FIG. 13, the first plate member 51, the second plate member 52, the third plate member 53, the fourth plate member 54, and the fifth plate member 55 have, in a plan view, an isosceles trapezoidal shape which has a long side and a short side parallel to each other and in which sides intersecting the long side and the short side parallel to each other have the same length.

Moreover, other configurations of the second embodiment are similar to those of the above-described first embodiment (Effects of the Second Embodiment)

In the second embodiment, the following effects can be obtained.

In the second embodiment, similarly to the above-described first embodiment, the expansion and contraction bags disposed between the plate members are expanded and contracted by air supply and exhaust to perform lifting/lowering, and thus the expansion and contraction bags can be flattened to be placed between the plate members by contracting the expansion and contraction bags. Thereby, the arrangement space of the movable portion 1 can be reduced as compared with a case of using a member for moving a rod, a column or the like having a certain size even in a contracted state, and thus the lifting/lowering device 100 (see FIG. 2) which can suppress an increase in the arrangement space in the up-down direction of the movable portion 1 can be provided. In addition, since the first side 521 and the second side 522 of the second plate member 52 face each other in a plan view, the first plate member 51 and the second plate member 52 are rotated to be inclined in opposite directions. Accordingly, the first plate member 51 can be moved horizontally up and down by equalizing the rotation angles of the first plate member 51 and the second plate member 52, and the first plate member 51 can be inclined by making the rotation angles of the first plate member 51 and the second plate member 52 different, and thus the first plate member 51 can be moved up and down and inclined by a common mechanism. As a result, compared with a case of arranging a column for performing up-down movement, an increase in the size of the movable portion 1 can be suppressed and the arrangement space in the up-down direction of the movable portion 1 can be suppressed from increasing.

In the second embodiment, as described above, the second plate member 52 has a substantially trapezoidal shape having a long side and a short side parallel to each other in a plan view, and the first plate member 51 or the second plate member 52 is rotated around the rotation axis along the side intersecting the long side and the short side parallel to each other in the substantially trapezoidal shape of the second plate member 52. Accordingly, unlike a case in which square and rectangular plate members are combined and inclined in order to incline the plate members in directions intersecting obliquely with respect to a long side and a short side parallel to each other in a plan view, the plate members can be inclined in the directions intersecting obliquely with respect to a long side and a short side parallel to each other in a plan view by the rotation around only one rotation axis. As a result, the plate members can be inclined in obliquely intersecting directions with a simple configuration.

Moreover, other effects of the second embodiment are similar to those of the above-described first embodiment.

Modification Examples

Moreover, the embodiments disclosed here should be considered as illustrative rather than restrictive in all points. The scope of the disclosure is shown by the scope of the claims rather than by the above description of the embodiments, and meaning equivalent to the scope of the claims and all modifications (modification examples) within the scope are included.

For example, in the above-described first embodiment, the example is shown in which the lifting/lowering device 100 is configured by five plate members and four expansion and contraction bags, but the disclosure is not limited hereto. In the disclosure, the lifting/lowering device may be configured by three plate members and two expansion and contraction bags, or may be configured by four plate members and three expansion and contraction bags.

In addition, in the above-described first and second embodiments, the example is shown in which the lifting/lowering device 100 is configured by five plate members and four expansion and contraction bags, but the disclosure is not limited hereto. In the disclosure, the lifting/lowering device may have n ($n \geq 3$) as the number of the plate members and n−1 as the number of the expansion and contraction bags.

Figure 14:
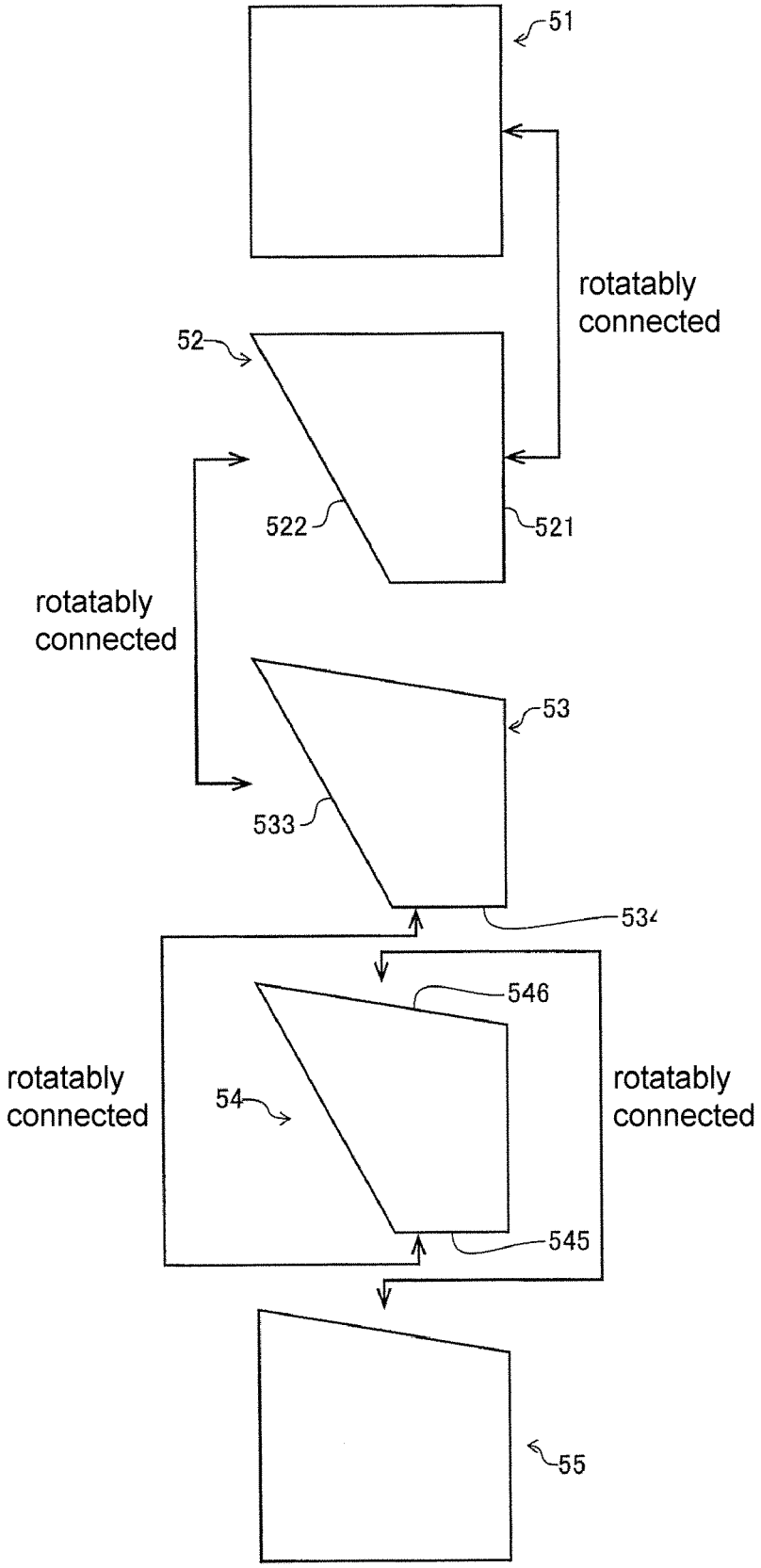
FIG. 14 is a diagram showing an example of plate members of a first modification example according to the first and second embodiments and connection of the plate members.

In addition, in the above-described first and second embodiments, the example is shown in which the plate members are formed in the same shape, but the disclosure is not limited hereto. In the disclosure, as in a first modification example shown in FIG. 14, shapes of the plate members may be made different from each other and sides intersecting at arbitrary angles are formed, and thereby the plate members are rotated to be respectively inclined around rotation axes along the formed sides.

Figure 15:
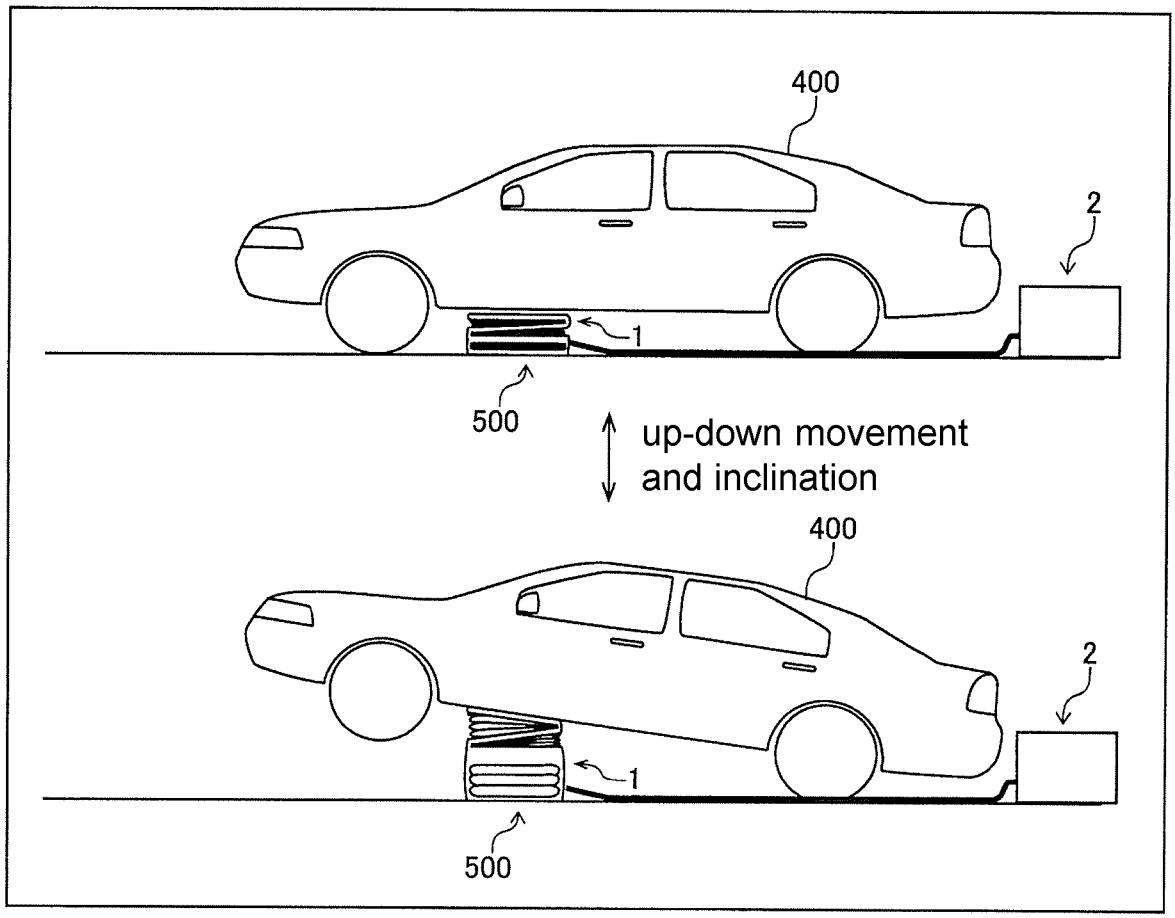
FIG. 15 is a diagram showing an example of a lifting/lowering device of a second modification example according to the first and second embodiments.

In addition, in the above-described first embodiment, the example is shown in which the lifting/lowering device 100 is the lifting/lowering device 100 for lifting/lowering the battery 201, but the disclosure is not limited hereto. In the disclosure, as in a second modification example shown in FIG. 15, the disclosure may be applied to a lifting/lowering device 500 which lifts/lowers a vehicle body of an automobile 400.

In addition, in the above-described first embodiment, the example is shown in which the supply and exhaust of the air to and from the first expansion and contraction bag 31 and the second expansion and contraction bag 32 is controlled based on the image captured by the image capturing portion 10, but the disclosure is not limited hereto. In the disclosure, the supply and exhaust of the gas to and from the first expansion and contraction bag and the second expansion and contraction bag may be controlled based only on the inclination angle of the first plate member or the pressures inside the expansion and contraction bags.

In addition, in the above-described first and second embodiments, the example is shown in which the channel switching portion 7 is included which switches the channels for supplying and exhausting the air to and from the first expansion and contraction bag 31 and the second expansion and contraction bag 32, but the disclosure is not limited hereto. In the disclosure, a pump may be arranged individually for each expansion and contraction bag to perform gas supply and exhaust individually without arranging the channel switching portion.

In addition, in the above-described first and second embodiments, the example is shown in which the control portion 20 is included which controls, based on the inclination angle of the first plate member 51, the supply and exhaust of the air to and from the first expansion and contraction bag 31 and the second expansion and contraction bag 32 to make the first plate member 51 move up and down or incline, but the disclosure is not limited hereto. In the disclosure, control of the gas supply and exhaust may be performed on the expansion and contraction bags based only on the pressures inside the expansion and contraction bags.

In addition, in the above-described first and second embodiments, the example is shown in which the pump 6 is included which performs the supply and exhaust of the air to and from the expansion and contraction bags, but the disclosure is not limited hereto. In the disclosure, the gas may be supplied to the expansion and contraction bags by pressure differences using a cylinder filled with compressed or liquefied gas without arranging the pump.

In addition, in the above-described first and second embodiments, the example is shown in which the drive device 2 driving the movable portion 1 is arranged, but the disclosure is not limited hereto. In the disclosure, the operator may manually supply and exhaust the gas to and from the expansion and contraction bags without arranging a drive device.

In addition, in the above-described first and second embodiments, the example is shown in which the inclination angle of the first plate member 51 is detected by the first angle sensor 41 arranged in the first plate member 51 of the movable portion 1 to control the supply and exhaust of the air to and from the expansion and contraction bags, but the disclosure is not limited hereto. In the disclosure, an angle sensor may be installed outside the movable portion, for example, on the object to be lifted/lowered to detect the inclination angle of the object to be lifted/lowered, or the supply and exhaust of the gas to and from the expansion and contraction bags may be controlled based on detection results of a sensor such as an acceleration sensor or the like included in the object to be lifted/lowered.

In addition, in the above-described first and second embodiments, the example is shown in which the angle sensor includes the acceleration sensor, but the disclosure is not limited hereto. In the disclosure, the angle sensor may be a sensor which directly measures an angle between two plate members, such as a rotary encoder or the like.

In addition, in the above-described first and second embodiments, the example is shown in which the channel switching portion 7 is configured by the electromagnetic valves arranged in each expansion and contraction bag, but the disclosure is not limited hereto. In the disclosure, a configuration is possible in which a disk-shaped valve body is rotated to open and close, or a plurality of disks in which holes serving as channels are arranged is rotated to switch to the channels with matching positions of the holes.

In addition, in the above-described first and second embodiments, the example is shown in which the drive device 2 includes the communication portion 8 and the operation portion 9, but the disclosure is not limited hereto. In the disclosure, only one of the communication portion and the operation portion may be arranged.

In addition, in the above-described first and second embodiments, the example is shown in which the pressure sensors are arranged for each expansion and contraction bag, but the disclosure is not limited hereto. In the disclosure, the pressure sensor may be arranged for only one of the expansion and contraction bags, or may be arranged only in the vicinity of the pump.

In addition, in the above-described embodiments, for convenience of explanation, the abnormality detection process of the control portion 20 of the disclosure is described using a flow-driven flowchart in which the process is performed in order along a process flow, but the disclosure is not limited hereto. In the disclosure, the process action by the control portion may be performed by an event-driven process in which the process is executed in unit of events. In this case, the process action may be performed by a complete event-driven process or a combination of the event drive and the flow drive.

What is claimed is:

1. A lifting/lowering device, characterized in that, comprising:

a first plate member which is arranged on a side where an object to be lifted/lowered is disposed;

a second plate member which is disposed below the first plate member and has a first side to which the first plate member is rotatably connected;

a first expansion and contraction bag which is disposed between the first plate member and the second plate member and is capable of expanding and contracting by gas supply and exhaust;

a third plate member which is disposed below the second plate member and to which the second plate member is rotatably connected at a second side different from the first side of the second plate member; and a second expansion and contraction bag which is disposed between the second plate member and the third plate member and is capable of expanding and contracting by gas supply and exhaust, wherein the first expansion and contraction bag is fixed at one end thereof by a fixing portion in a manner of being pulled to a side of a rotation axis between the first plate member and the second plate member, and the second expansion and contraction bag is fixed at one end thereof by a fixing portion in a manner of being pulled to a side of a rotation axis between the second plate member and the third plate member.

2. The lifting/lowering device according to claim 1, wherein each of the first expansion and contraction bag and the second expansion and contraction bag has an annular part arranged at the one end thereof, and each of the first expansion and contraction bag and the second expansion and contraction bag is fixed at the one end thereof by passing the fixing portion through hole in the annular part and being pulled.

3. The lifting/lowering device according to claim 1, wherein each of the first expansion and contraction bag and the second expansion and contraction bag is configured by stacking a plurality of bags, and one ends of the plurality of stacked bags are welded or bonded together and fixed by being pulled.

4. The lifting/lowering device according to claim 3, wherein each of the stacking bags is formed by welding or bonding edges of two sheet-like members and which is substantially flat when contracted.

5. The lifting/lowering device according to claim 1, wherein the first plate member, the second plate member, and the third plate member are configured to be wrapped by a sheet, and each of the first expansion and contraction bag and the second expansion and contraction bag is fixed to the sheet or a corresponding plate member among the first plate member, the second plate member and the third plate member at the one side by being pulled.

6. The lifting/lowering device according to claim 1, wherein the first plate member, the first expansion and contraction bag, the second plate member, the second expansion and contraction bag and the third plate member are disposed so as to overlap in a plan view.

7. The lifting/lowering device according to claim 1, wherein the second plate member has a substantially trapezoidal shape having a long side and a short side parallel to each other in a plan view, and the first plate member or the second plate member is rotated around a rotation axis along a side intersecting the long side and the short side parallel to each other in the substantially trapezoidal shape of the second plate member.

8. The lifting/lowering device according to claim 1, further comprising:

a fourth plate member which is disposed below the third plate member and has a fifth side to which the third plate member is rotatably connected at a fourth side different from a third side of the third plate member connected to the second plate member;

a third expansion and contraction bag which is disposed between the third plate member and the fourth plate member and is capable of expanding and contracting by gas supply and exhaust;

a fifth plate member which is disposed below the fourth plate member and to which the fourth plate member is rotatably connected at a sixth side different from the fifth side of the fourth plate member, and a fourth expansion and contraction bag which is disposed between the fourth plate member and the fifth plate member and is capable of expanding and contracting by gas supply and exhaust, wherein the first plate member, the first expansion and contraction bag, the second plate member, the second expansion and contraction bag, the third plate member, the third expansion and contraction bag, the fourth plate member, the fourth expansion and contraction bag and the fifth plate member are disposed so as to overlap in a plan view, and at least two of the rotation axes when the first plate member, the second plate member, the third plate member, the fourth plate member and the fifth plate member are rotated intersect in a plan view.

* * * * *